US005698805A

United States Patent [19]

Thompson et al.

[11] Patent Number: 5,698,805

[45] Date of Patent: Dec. 16, 1997

[54] TONE SIGNAL GENERATOR FOR PRODUCING MULTIOPERATOR TONE SIGNALS

[75] Inventors: Charles D. Thompson, Buda; Salvador R. Bernadas; Michael V. Jenkins, both of Austin, all of Tex.

[73] Assignee: Crystal Semiconductor Corporation, Austin, Tex.

[21] Appl. No.: 528,031

[22] Filed: Sep. 14, 1995

Related U.S. Application Data

[63] Continuation-in-part of Ser. No. 497,044, Jun. 30, 1995.

[51] Int. Cl.[6] ..... G10H 1/08; G10H 1/14; G10H 1/18

[52] U.S. Cl. ..... 84/615; 84/617; 84/624; 84/625

[58] Field of Search ..... 84/615–620, 622–633, 84/115

[56] References Cited

U.S. PATENT DOCUMENTS

| | | | |
|---|---|---|---|
| Re. 33,558 | 3/1991 | Katoh | 84/605 |
| 4,018,121 | 4/1977 | Chowning | 84/1.01 |
| 4,138,915 | 2/1979 | Nagai et al. | 84/1.22 |
| 4,201,105 | 5/1980 | Alles | 84/1.01 |
| 4,249,447 | 2/1981 | Tomisawa | 84/1.01 |
| 4,297,933 | 11/1981 | Nishimoto | 84/1.01 |
| 4,301,704 | 11/1981 | Nagai | 84/1.22 |
| 4,406,204 | 9/1983 | Katoh | 84/1.19 |
| 4,422,362 | 12/1983 | Chibana | 84/1.19 |
| 4,455,911 | 6/1984 | Yamada | 84/1.19 |
| 4,480,521 | 11/1984 | Schmoyer | 84/115 X |
| 4,554,857 | 11/1985 | Nishimoto | 84/1.19 |
| 4,616,546 | 10/1986 | Uchiyama et al. | 84/1.01 |
| 4,643,066 | 2/1987 | Oya | 84/1.01 |
| 4,788,896 | 12/1988 | Uchiyama | 84/1.01 |
| 4,813,326 | 3/1989 | Hirano | 84/1.01 |
| 4,843,935 | 7/1989 | Car-Lai | 84/DIG. 22 |
| 5,033,352 | 7/1991 | Kellogg et al. | 84/658 |
| 5,076,133 | 12/1991 | Toda | 84/624 |
| 5,094,136 | 3/1992 | Kudo et al. | 84/603 |

OTHER PUBLICATIONS

Samson, "A General–Purpose Digital Synthesizer," *J. Aud. Eng. Soc.*, Mar. 1980, pp. 106–113.

Yamaha® LSI, YMF278B FM+ Wave table Synthesizer LSI, YMF288 Catalog, Catalog No. LSI–4MF2783, 1994, pp. 1–22.

*Computer Music Journal*, A One–Card 64 Channel Digital Synthesizer, vol. 1, No. 4, Nov. 1977, pp. 7–9.

CS9203, *Advanced MusicSynthesizer*, Crystal Semiconductor Corporation Preliminary Product Information, Nov. 1993, pp. 1–19.

Yamaha® LSI, OPL3–L, *YMF289 FM Synthesizer Application Manual*, Ver. 1.02, pp. 1–45.

Yamaha® LSI, *YM3812 FM Operator Type–LII (OPL II)*, Catalog No. LSI–2128122, ©1989, pp. 1–10.

YM382 FM Operator Type–L (OPL II), Application Manual, ©1987, pp. 1–31.

Yamaha Systems Technology, *YMF262 FM Operator Type L3 (OPL3)*, pp. 1–15.

Yamaha® LSI, *YMF262 FM Operator Type L3 (OPL3)*, ©1988, pp. 1–17.

(List continued on next page.)

*Primary Examiner*—Stanley J. Witkowski
*Attorney, Agent, or Firm*—Ken J. Koestner; J. P. Violette

[57] ABSTRACT

The present invention relates to a tone signal generator. The tone signal generator includes first tone signal generation means for producing a dual-tone, multi-frequency ("DTMF") audio signal; second tone signal means for producing a plurality of non-DTMF audio signals; storage means for storing data that represents at least one channel of an output audio tone signal; and selection means for selectively loading the DTMF signal into the storage means and for selectively accumulating the non-DTMF signals into the storage means so as to generate the output tone signal.

19 Claims, 16 Drawing Sheets

OTHER PUBLICATIONS

H.G. Alles, *An Inexpensive Digital Sound Synthesizer,* Computer Music Journal, vol. 3, No. 3, Fall of '79,pp. 28–37.

Harold G. Alles, *Music Synthesis Using Real Time Digital Techniques,* Proceedings of the IEEE, vol. 68, No. 4, Apr. 1980, pp. 436–449.

Yamaha Corporation, *Yamaha LSI YMF278–F (OPL4), 4 Operator FM and Wave Synthesis Chip,* Application Manual, Apr. 1, 1993, pp.1–32.

61
MUX 63
Phase Gen 62
State 68
Phase Accum 64
env level 66
MUX 86
MUX 84
MUX 82
Mult 88
102
100
76
Addr gen. 74
Addr Latch
Memory
Phase Angle 78
Volume 80
60
From Control Circuit
70

20
130
132
CNT
CNT3
CONN SEL
NEW
RHY
WSEL
Master Control 142
CNTR 140
To I/O Bus
TR
OCT
DTR
RF
VB
Slave Sequencer 150
To I/O Bus
CH0A
CH0B
NEW
PIN
Stereo/ Mono Check 152
Accum CNTL 154
OCT
DVB
SP
FN
KSL
RF
EL
TL
WSEL
Addr Gen. 74
To Data Path
ADDR To Accum
MEM 76
RATE

TONE SIGNAL GENERATOR FOR PRODUCING MULTIOPERATOR TONE SIGNALS

CROSS REFERENCE TO RELATED APPLICATION

This application is a continuation in part of copending, commonly assigned U.S. patent application Ser. No. 08/497,044 filed on Jun. 30, 1995, entitled Tone Signal Generator for Producing Multioperator Tone Signals and having attorney docket number M-3218. The above-referenced application is incorporated herein by reference in its entirety.

BACKGROUND OF THE INVENTION

The present invention relates to a tone signal generator and more particularly, to a tone signal generator which is capable of producing frequency modulation (FM) multioperator tone signals.

A digital tone signal generator is a general electronic circuit which generates polyphonic digital output signals representing music and other types of sound. An output digital-to-analog converter ("DAC") converts the tone signal generator's digital output signals into analog signals. A speaker converts the analog signals into sound waves. Chowning, U.S. Pat. No. 4,018,121 is an example of a device which synthesizes sound using frequency modulation.

In generating the polyphonic digital output signals, it is known to use a plurality of operators (also known as operation units or operation channels) to generate a tone signal having a particular tone color. The number and type of operators as well as the manner in which these operators are combined dictate the particular tone color. For example, Samson, "A General-Purpose Digital Synthesizer," *J. Aud. Eng. Soc.*, March 1980, pp. 106–113 describes a digital musical synthesizer which includes a plurality of building blocks of digital synthesis.

It is known to use feedback to adjust the tone color of a tone signal. For example, FIG. 1, labeled prior art, shows an operator which includes a feedback path for adjusting the tone color of a tone signal. In this system, an operator circuit, which includes a waveform generator, receives the sum of a modulation input signal (m(t)) and a tone feedback signal. The operator circuit provides a tone signal (e(t)) based upon the modulation input signal m(t) and the tone feedback signal. The tone signal is multiplied by an amplitude signal (A(t)) as well as by a feedback value (β) to provide the tone feedback signal. An example of a tone generator which includes the use of feedback is the tone generator disclosed in Tomisawa, U.S. Pat. No. 4,249,447. However, while Tomisawa includes an averaging circuit with corresponding memory and shows an amplitude multiplier for performing the amplitude multiplication, this amplitude multiplier is not located in the feedback path.

It is also known to store progressive phase angle samples of a waveshape in a waveshape table and to use these samples to derive a carrier or modulating wave signal. For example, Hirano et at., U.S. Pat. No. 4,813,326, discloses synthesizing music tones where the modulating wave and carrier wave are derived from waveshape samples that are stored within respective wave tables.

It is also known to provide tone generators which generate types of tone signals. For example, U.S. Pat. No. 5,094,136 discloses a system which includes two tone generator circuits, one circuit for generating a prestored plural waveform type tone signal and one circuit for generating a frequency modulation (FM) type tone signal.

SUMMARY OF THE INVENTION

The present invention relates to a tone signal generator. The tone signal generator includes first tone signal generation means for producing a dual-tone, multi-frequency ("DTMF") audio signal; second tone signal means for producing a plurality of non-DTMF audio signals; storage means for storing data that represents at least one channel of an output audio tone signal; and selection means for selectively loading the DTMF signal into the storage means and for selectively accumulating the non-DTMF signals into the storage means so as to generate the output tone signal.

DETAILED DESCRIPTION

The following description is intended to be illustrative of the invention and should not be taken to be limiting.

Figure 1:
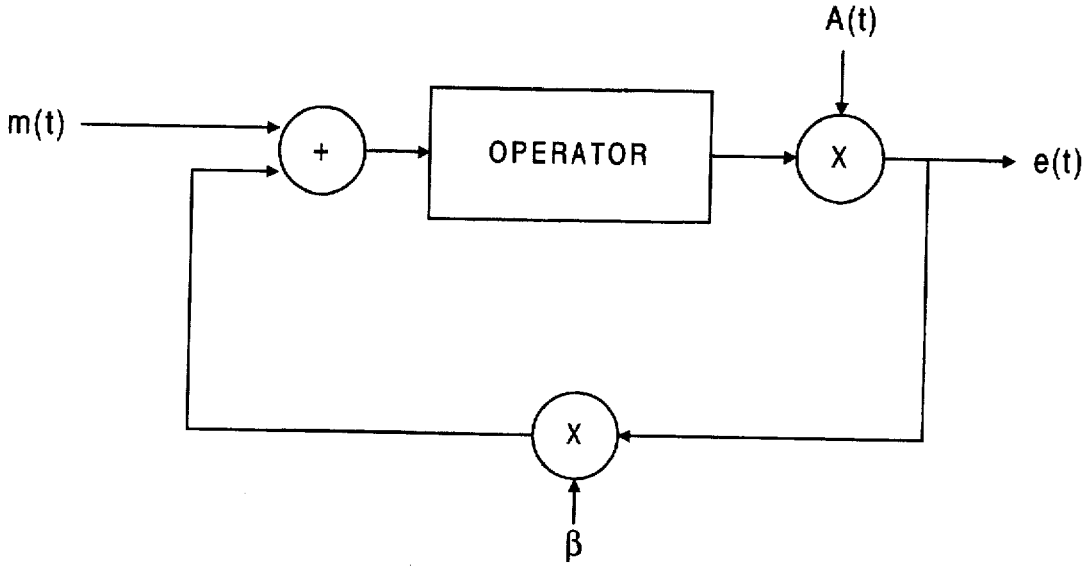
FIG. 1 (Prior Art)
FIG. 1, labeled prior art, is a functional block diagram of a tone signal generator.
Figure 2:
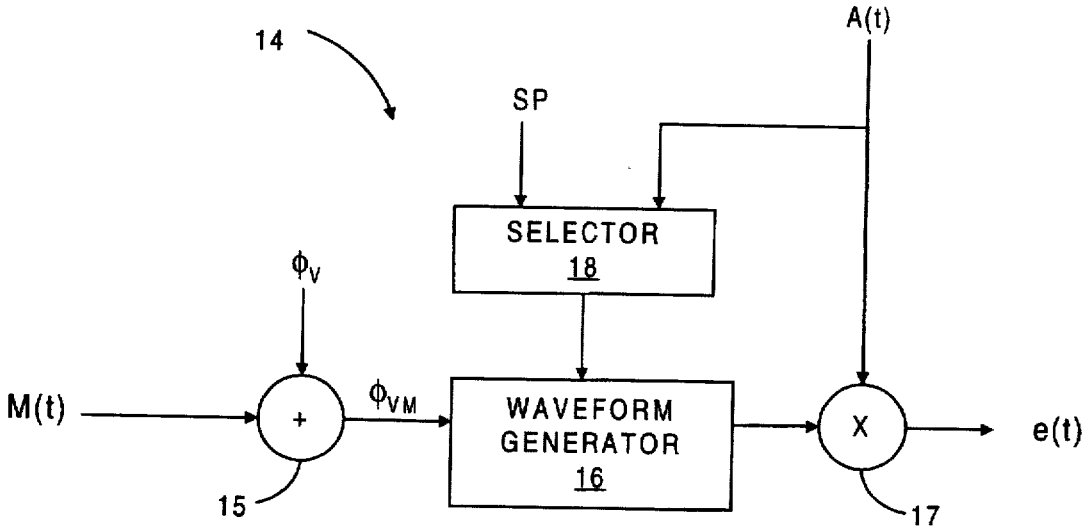
FIG. 2 is a functional block diagram of a tone signal generator in accordance with the present invention.

FIG. 2 shows a functional block diagram of a tone signal generator for generating a tone signal without the use of feedback. Tone signal generator 14 includes adder 15 coupled to waveform generator 16 coupled to enveloper 17. Waveform generator 16 is also coupled to selector 18. Adder 15 receives a modulation input signal (M(t)) as well as a phase angle input signal ($\phi_V$). Adder 15 provides the combination of these signals to provide a phase angle signal ($\phi(t)$). In addition to being coupled to waveform generator 16, enveloper 17 receives an amplitude signal (A(t)).

Waveform generator 16 includes a plurality of wave tables. Each wave table storing a waveshape along with variations of each waveshape corresponding to, for example, different amounts of simulated feedback. Each waveshape is stored as a plurality of waveshape samples; consecutive waveshape samples being interpolated between by an interpolator within waveform generator 16 to provide the actual waveshape signal.

Selector 18 receives a scaling parameter signal (SP) as well as a portion of amplitude signal (A(t)). Selector 18 provides a selection value as an output signal. Selector 18 stores a plurality of selection values in respective memory locations. The combination of the scaling parameter signal and the portion of the amplitude signal accesses a memory location within a selection table in selector 18 and thus accesses a particular selection value.

Adder 15 produces the phase angle address signal $\phi_{VM}$ by combining the modulation input signal M(t) with the phase angle input signal $\phi_V$. The phase angle input signal $\phi_{VM}$ represents a frequency that characterizes the tone to be generated by tone signal generator 14. The selection value accesses a particular waveshape of a waveshape selected by the waveshape select signal. Phase angle signal $\phi_{VM}$ accesses a waveshape sample of the particular waveshape.

Figure 3:
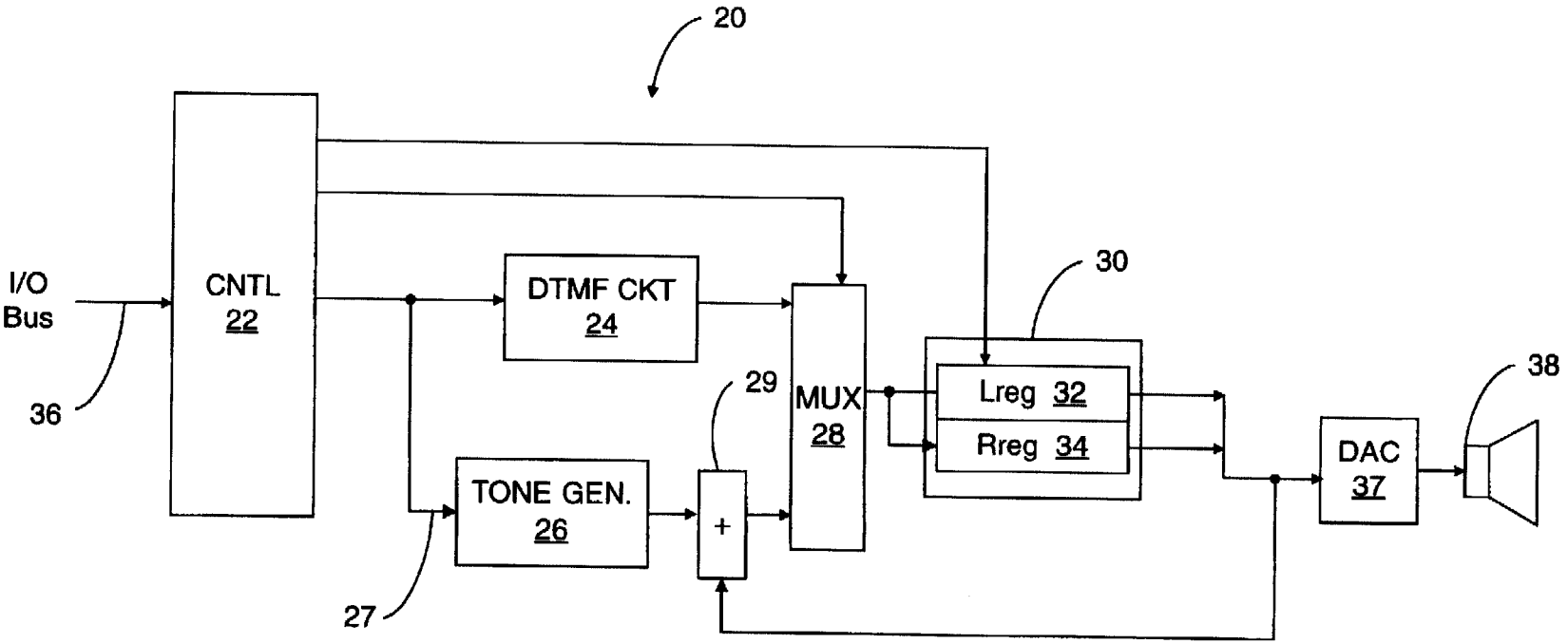
FIG. 3 is a schematic block diagram of a tone signal generator in accordance with the present invention.

FIG. 3 shows tone signal generator 20 which implements the functions of tone signal generator 14. Tone signal generator 20 includes control circuit 22, coupled to dual-tone multi-frequency (DTMF) circuit 24 and tone signal generation circuit 26 via multifunction control bus 27. Control circuit 22 is coupled to input/output (I/O) bus 36 which is, for example, a bus which conforms to the Industry Standard Architecture (ISA) bus standard and multifunction control bus 27. DTMF circuit 24 is coupled to and provides a DTMF tone signal to multiplexer (MUX) 28. Tone signal generation circuit 26 is coupled to and provides a tone signal to multiplexer 28 via adder 29. Multiplexer 28 passes one of these tone signals to output register circuit 30, which includes left output register (Lreg) 32 and right output register (Rreg) 34. Left and right output registers 32, 34 hold left and right channel digital output data. The digital tone signals from output registers 32, 34 are supplied to digital to analog converter (DAC) 37 for conversion of the digital output signals to analog output signal. The analog output signal is provided to speaker 38 which converts the analog output signal into sound waves. The digital output data from registers 32, 34 is also fed back to adder 29 which adds this signal to the tone signal which is generated by tone signal generation circuit 26 to provide an operator output signal which is provided to multiplexer 28. Control circuit 22 is also coupled to, and controls, multiplexer 28, adder 29 and output register circuit 30 via a plurality of control signal paths.

The combination of adder 29 and register circuit 30 provides an output accumulator. Because register circuit 30 includes left and right registers 32, 34, the output accumulator provides two output channels and thus is a stereo output accumulator.

Control circuit 22 controls the generation of tone signals for tone signal generator 20. Control circuit 22 includes a sequence control circuit which controls the sequence of interaction of the various circuits of tone signal generator 20 and thus sequences the generation of tone signals.

DTMF circuit 24 includes a group of hard-wired operators that furnish a dual-tone multi-frequency sound capability of the general type used in telephone systems. The DTMF operators are separate from the operation circuitry within tone signal generation circuit 26. The eight DTMF operators are divided into a high-tone group 21 of four operators and a low-tone group 23 of four operators. The tone signals of the high-tone group 21 represent tones of higher frequency than the tone signals of the low-tone group 23. DTMF circuit 24 selectively combines one of the high-tone signals and one of the low-tone signals to produce a dual-tone signal as a DTMF output signal. More specifically, DTMF selector 25 selects one of the low-tone signals and one of the high-tone signals and DTMF combiner 31 combines the selected low-tone signal and the selected high-tone signal to produce the dual-tone signal. The dual-tone signal is selectively furnished via multiplexer 28 to both of the pair of output registers 32, 34 that respectively hold the digital audio output data for the left and right audio output channels.

Tone signal generation circuit 26 includes FM synthesis circuitry that establishes a group of internal tone-generation channels. Each tone-generation channel furnishes an internal digital tone signal that represents a unique, typically musical, tone. The number of available internal tone-generation channels established by tone signal generation circuit 26 varies from 12 to 20 depending on a user's needs. Tone signal generation circuit 26 combines the digital tone signals generated by each tone generation channel to produce a pair of digital polyphonic audio signals.

Tone signal generation circuit 26 includes a single set of real signal-processing elements which are time-division multiplexed to calculate 36 FM virtual operators. Each virtual operator has a separate accumulation register for accumulating phase angle data. That is, there are 36 real phase angle accumulation registers for the 36 virtual operators. Each internal tone-generation channel is typically formed with two or four virtual operators arranged in an FM configuration that employs the data from the corresponding phase accumulators.

Figure 4:
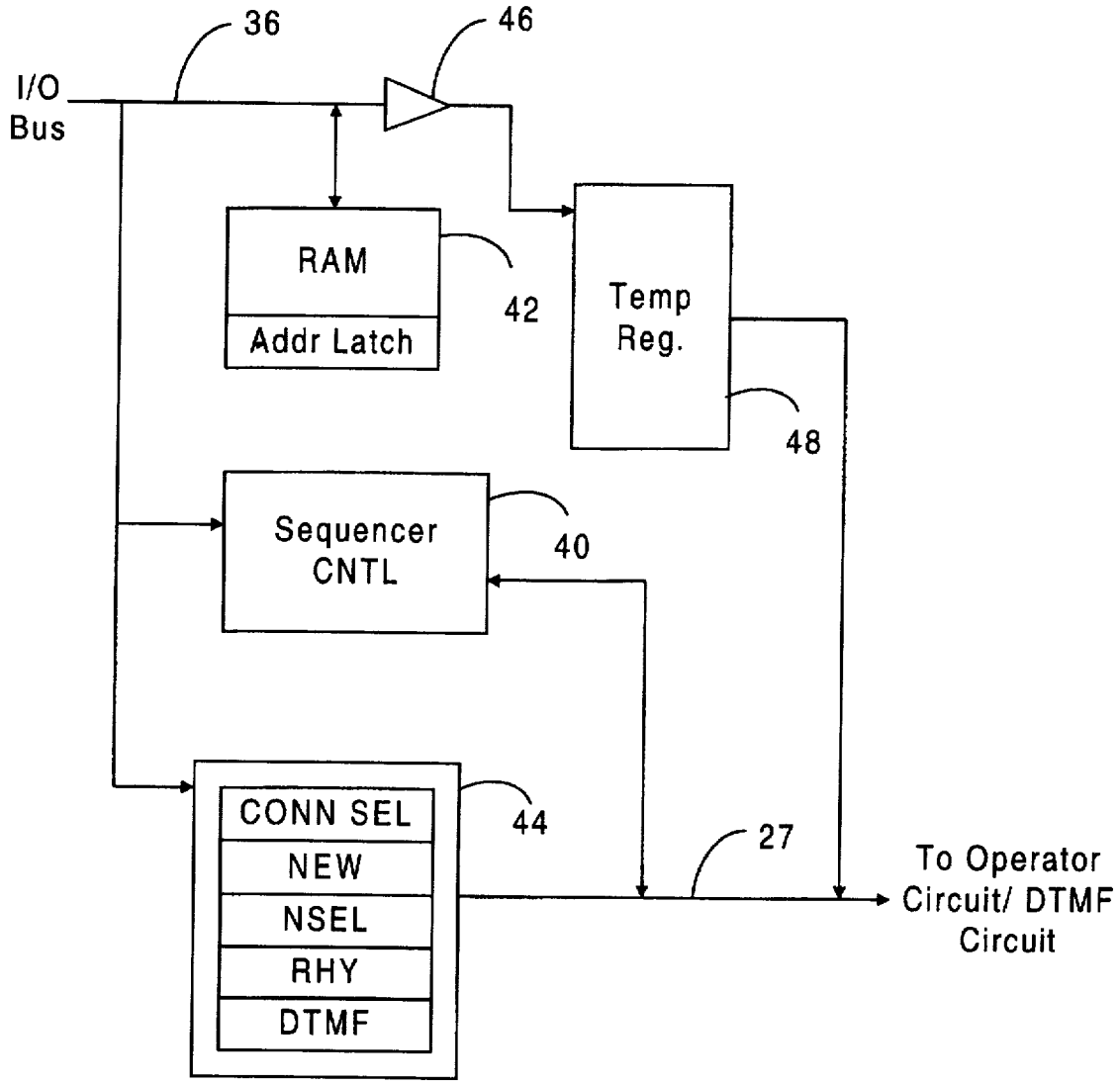
FIG. 4 is a schematic block diagram of a control circuit of the tone signal generator of FIG. 3.

Referring to FIG. 4, control circuit 22 includes sequencer control circuit 40, memory 42, control register 44, input buffer 46 and temporary register circuit 48. Sequencer control circuit 40, memory 42, control register circuit 44 and input buffer 46 are coupled to I/O bus 36. Input buffer 46 is coupled to and controls whether information is passed from I/O bus 36 to temporary register circuit 48. Sequencer control circuit 40, control register circuit 44 and temporary register circuit 48 are also coupled to control bus 27. Additionally, sequencer control circuit 40 is coupled via control signal paths to the various circuitry throughout tone signal generator 20.

Sequencer control circuit 40 includes a sequence control state machine and controls the sequence in which the various circuit elements of tone generator 20 interact to produce the digital tone signals.

Memory 42 is a random access memory (RAM) which includes an associated address latch and which stores input parameters and status data for the 36 FM virtual operators. The input parameters and status data for the 36 virtual operators are provided to memory 42 via bus 36 under user control. Typically, the input parameters and status data are generated by a driver program which is accessed by a user or by an application program with which a user is interacting. For example, when a user desires and chooses a particular tone, either directly or via an application program, the parameters which characterize that tone are loaded via I/O bus 36 into memory 42. This parameter and status information is then loaded from memory 42 into temporary register circuit 48 on an operator by operator basis for use in generating particular operators.

Control register circuit 44 includes a plurality of control registers. More specifically, control register circuit 44 includes a mode selector register (CONN SEL), an expansion enable register (NEW), a note selection register (NSEL), a rhythm mode control register (RHY), and a DTMF register (DTMF). The mode selector register CONN SEL holds input information that determines how the 36 virtual operators are divided among the internal tone-generation channels. Expansion enable register NEW holds information regarding whether tone generator 20 is to operate in a downwardly compatible mode of operation. Note selection register NSEL holds information regarding how to split a keyboard which is used in a downwardly compatible mode of operation. Rhythm mode control register RHY holds information regarding whether operators should be used in generating rhythm tones or multioperator tones. The DTMF register holds information regarding generation of DTMF tones.

Temporary register circuit 48 includes a plurality of temporary registers which are loaded from memory 42 via input buffer 48, which is a pass no-pass holding buffer under control of sequencer control circuit 40. The temporary registers provide temporary storage of parameters for calculating individual virtual operators. More specifically, temporary register circuit 48 includes a scaling parameter register (SP) which stores a scaling parameter value representing various amounts of simulated feedback, an envelope sustain level register (EL), a total envelope level register (TL,), a depth of vibrato register (DVB), a waveform select register (WSEL) which selects one of eight waveforms, a key scale level register (KSL), an operator in octave register (OCT), a frequency number register (FN) which sets the pitch of the operator within a selected octave, a multiplier register (RF) which sets the frequency ratio between two operators, an envelope attack rate register (AR), an envelope decay rate register (DR), an amplitude modulation control register (TR) which sets the tremolo level of an operator, a vibrato control register (VB), an envelope generator mode control register (EGT), a key on control bit register (KON) which indicates that a channel (i.e., a note) is active, a synthesis algorithm selector register (CNT), an output channel selector for the right audio channel register (CHOA) and an output channel selector for the left audio channel register (CHOB).

Figures 5, 5A, 5B:
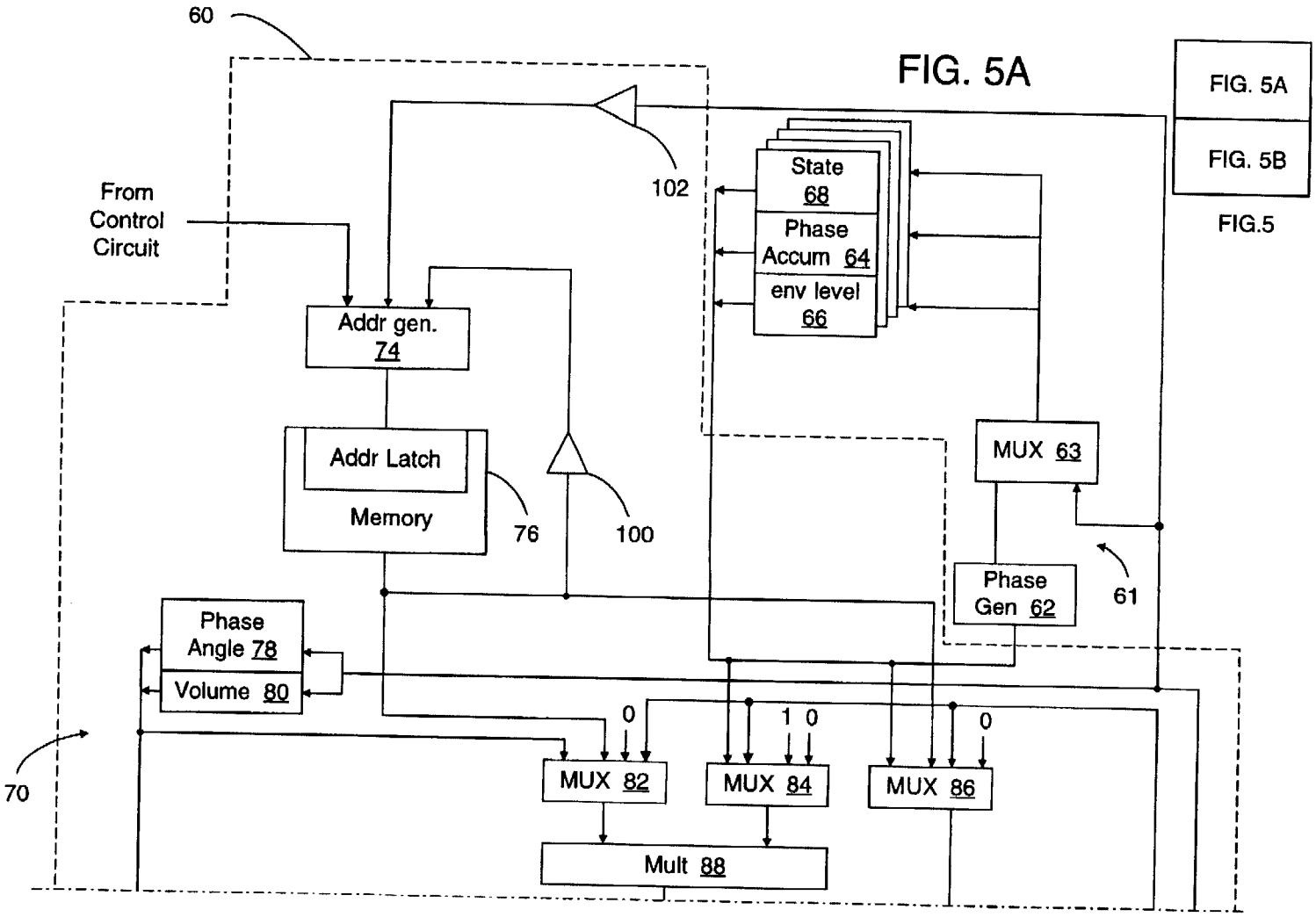
FIG. 5 is a schematic block diagram of an operator circuit of the tone signal generator of FIG. 3.
Figure 5B:
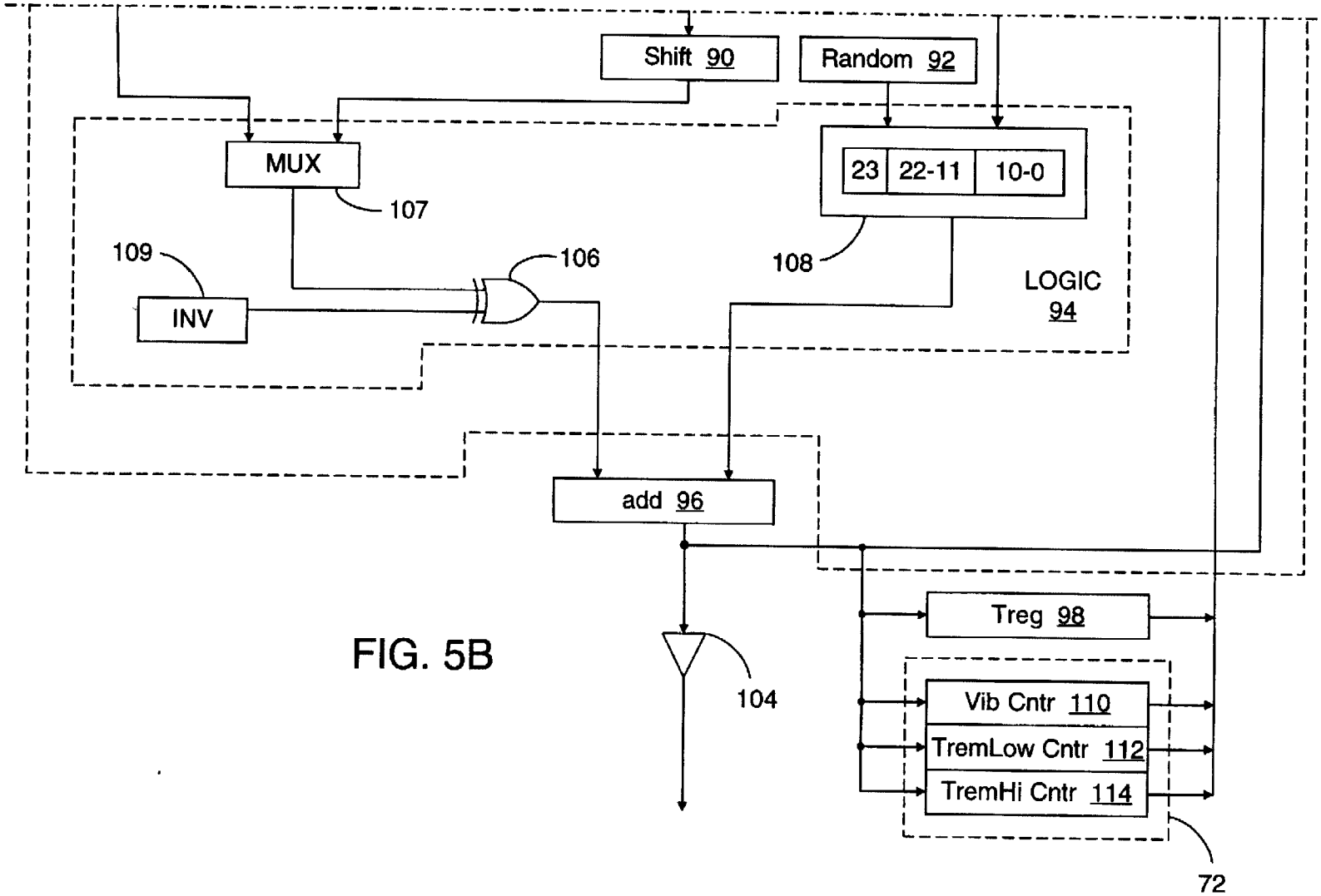

Referring to FIG. 5, tone signal generation circuit 26 includes time multiplexed operator circuit 60 as well as 36 phase angle accumulation registers shown as phase accum block 64, 36 output envelope-level registers shown as env level block 66 and 36 state registers shown as state block 68. Tone signal generation circuit 26 also includes phase angle portion 61 having phase angle generator (phase gen) 62 and phase angle generator multiplexer 63. Phase angle generator 62 is time division multiplexed to provide 36 virtual phase angle generators corresponding to each phase angle accumulation register 64. The information held in phase angle accumulation registers 64, output envelope registers 66 and state registers 68 is provided to operator circuit 60.

Phase angle generator 62 calculates phase angle increments as a function of parameters FN, OCT, and RF held in temporary register circuit 48. The phase angle increments generated by phase angle generator 62 are provided via one input of multiplexer 63 to phase angle accumulation register 64 for each operator. The other input to multiplexer 63 is provided by operator generation circuit 60. Phase angle accumulation registers 64, envelope-level registers 66 and state registers 68 are 36 individual replications of the same circuitry.

Time multiplexed operator circuit 60 includes a core signal-processing circuit 70 and low-frequency oscillator sources 72. The core signal processing circuit includes address generator (addr gen) 74, memory 76 (including an associated address latch), phase angle register (phase angle) 78, volume register (Volume) 80, multiplexers 82, 84, 86, multiplier (mult) 88, shifter (shift) 90, random number generator (random) 92, logic 94, adder (add) 96, temporary register (treg) 98, and buffers 100, 102, and 104.

Addresses for accessing memory 76 are produced by address generator 74 based upon information provided by control circuit 22 as well as information generated within operator circuit 60. Memory 76 includes a wave table region as well as a plurality of regions for storing information used in generating an operator is stored. The information accessed within the various regions of memory 76 is provided to multiplexers 82 and 86. Multiplexers 84 and 86 also receive input information from phase angle accumulators 64 and envelope-level registers 66. Multiplexers 82 and 84 provide output signals to multiplier 88. Multiplier 88 provides its output signal to shifter 90.

Shifter 90 shifts product data provided by multiplier 88 up to two bits to the left or up to 15 bits to the right with sign extension. Random number generator 92 produces pseudo random numbers (noise) for simulating the noise-like (chaotic) effect of operators with high simulated feedback. Multiplexer 86 and shifter 90 provide their output signals to logic 94.

Phase angle register 78 holds a 21-bit wave-table phase angle address $\phi_{VM}$ for the current operator calculation. Volume register 80 holds two 24-bit signals at different times: (a) an amplitude envelope signal E(t) and (b) the digital operator output signal e(t) from the immediately previous operator calculation. Phase angle register 78 and volume register 80 provide output signals to multiplexer 82 as well as a direct connection to logic 94.

Logic 94 provides two signals to adder 96. One of the signals is either the output signal from multiplexer 86 or noise from random number generator 92. The other signal is the true or complement value of either the shifter output signal or the $\phi(t)/E(t)$ data supplied on the bus portion connected to the outputs of phase angle and volume registers 78, 80, respectively. By providing the data stored in registers 78, 80 directly to logic 94, multiplexer 82 may be bypassed. Because multiplexer 82 is 12-bits wide, bypassing this multiplexer enables the entire bit width of the $\phi_{VM}$ signal stored in phase angle register 78 to be provided to logic 94.

Logic 94 includes exclusive OR gate 106, multiplexer 107, multiplexer circuit 108 and inverter circuit 109 for performing these operations. More specifically, multiplexer 107 receives the $\phi_{VM}$ signal as well as the output of shifter 90 and provides an output signal to exclusive OR gate 106. The other input to exclusive OR gate 106 is an inversion signal generated by inverter circuit 109. This inversion signal is a 24-bit wide signal which is either all "1's" or all "0's". Accordingly, providing this signal as the other input of exclusive OR gate 106 allows the two's complement (when used with an internally generated carry-in) of the output of multiplexer 107 to be generated, thus providing an effective way of subtracting the output of multiplexer 107 using adder 96. Logic 94 also includes multiplexer 108 which receives the signal provided by random number generator 92 as well as the output signal of multiplexer 86. Multiplexer circuit 108, under control of control circuit 22, selectively inserts the output of random number generator 92 into bit locations 11–22 of the signal provided by multiplexer 86. Accordingly, multiplexer circuit 108 selectively adds noise to the operator signal.

Temporary register 98 provides temporary storage for intermediate values generated by operator circuit 60 during the generation of an operator output value. The contents of temporary register 98 are updated each clock cycle based upon the value provided by adder 96.

Adder 29 (see FIG. 3) is selectively provided from adder 96 through pass/no pass holding buffer 104 as the digital output tone signal (e(t)) from the real operator.

The low-frequency oscillator sources 72 include vibrato oscillator (vib cntr) 110 and a pair of tremolo oscillators (tremLow cntr and tremHi cntr) 112, 114, respectively. Vibrato oscillator 110 produces vibrato, i.e., a sub-audio constant-amplitude signal at a constant frequency of, for example, approximately 6 Hz. Tremolo oscillators 112, 114 generate sub-audio constant-frequency tremolo signals at a pair of amplitudes. The tremolo frequency is, for example, approximately 4 Hz. Only one of the tremolo signals is employed in calculating any particular operator. The use of both vibrato and tremolo is at a user's option for each virtual operator.

Figures 6, 6A, 6B:
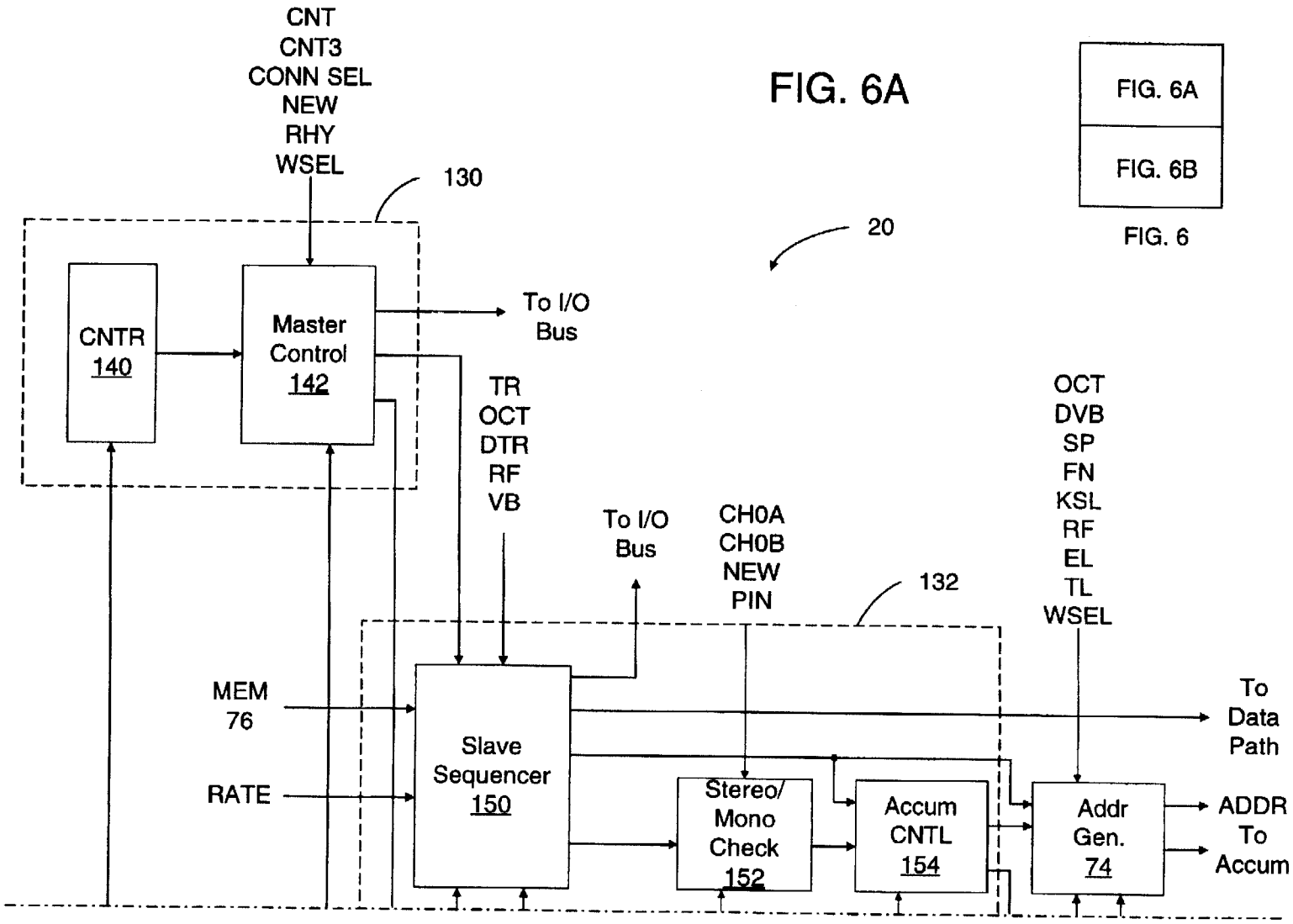
FIG. 6 is a schematic block diagram of a sequencer circuit of the control circuit of FIG. 4.
Figure 6B:
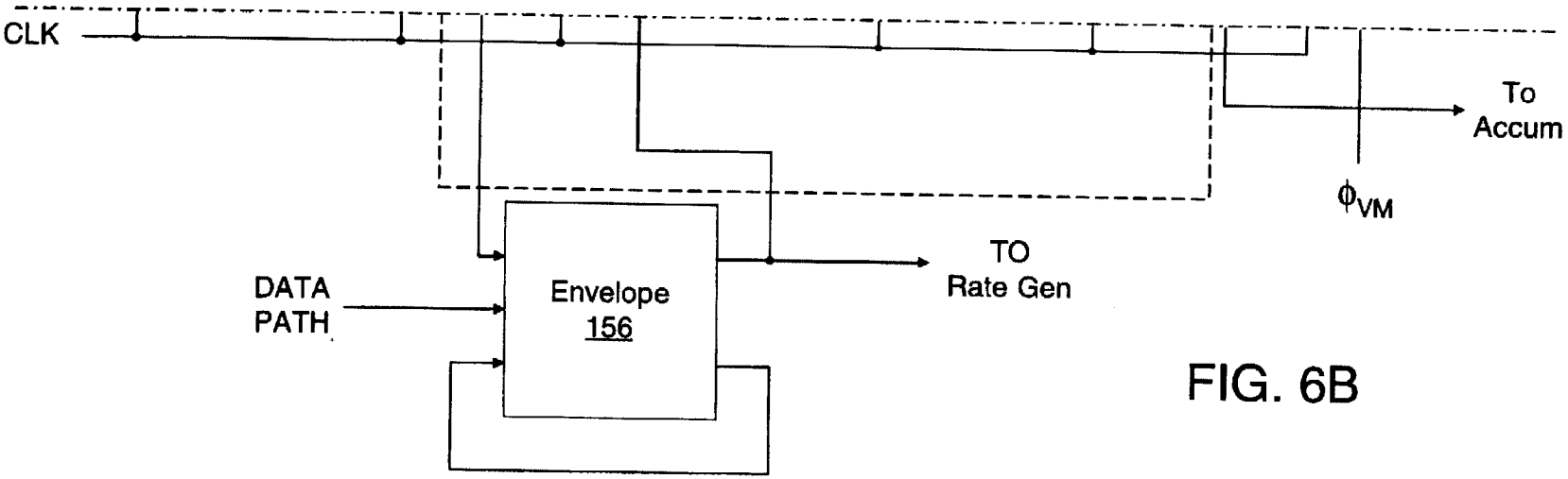

FIG. 6 shows a sequence control circuit 40 which includes master portion 130 and slave portion 132. FIG. 6 also shows how the output of slave portion 132 is provided to address generator 74.

Master portion 130 controls the operation of tone generator 20 for all operators generated by tone generator 20. Slave portion 132 controls the operation of tone signal generation circuit 26 for each operator. Sequence control circuit 40 receives a system clock signal (CLK) which synchronizes the operation of the various elements of sequence control circuit 40.

Master portion 130 includes counter 140 and master control circuit 142. Counter 140 receives the system clock signal and produces a count signal which is provided to master control circuit 142. Master control circuit 142 uses this count signal to control the generation of individual operators as well as the generation of all of the operators. Master control circuit 130 receives, among others, the CONN SEL, NEW, RHY and WSEL signals stored within control register circuit 44 (FIG. 4). Master control circuit 130 also receives the channel control signals CNT and CNT3. The mode selection signal CONN SEL indicates whether a channel is part of a four operator note. The channel connection signals CNT, CNT3 indicate which algorithm is used, i.e., how different virtual operators are configured to provide a desired tone. Based upon these master control signals, master control circuit 142 controls the operation of slave portion 132 and also provides status information back to I/O bus 36.

Slave portion 132 includes slave sequencer 150, stereophonic/monophonic control 152, and accumulator control 154 as well as envelope controller 156. Slave sequencer 150 receives the TR, OCT, depth of tremelo (DTR), RF and VB signals as well as information from memory 76 and controls the generation of individual operators. More specifically, slave sequencer 150 provides an address generation control signal to address generator 74 which controls the sequence with which address generator 74 generates addresses for accessing memory 76, a stereo sequence control signal which controls when the determination of whether to generate a stereophonic or monophonic tone signal is generated and an accumulator sequence control signal which controls the sequence with which the phase accumulator provides and receives phase accumulation information. Stereophonic/monophonic control 152 receives the stereo sequence control signal as well as the CHOA, CHOB, NEW and left/right channel selector (PIN) signals from temporary register circuit 48 and provides a stereo control signal which determines the sequence with which registers 32, 34 are accessed. Accumulator control 154 receives the accumulator sequence control signal and provides an accumulator control signal to phase accumulators 64 which controls the operation of each of the phase accumulators 64.

Figure 7:
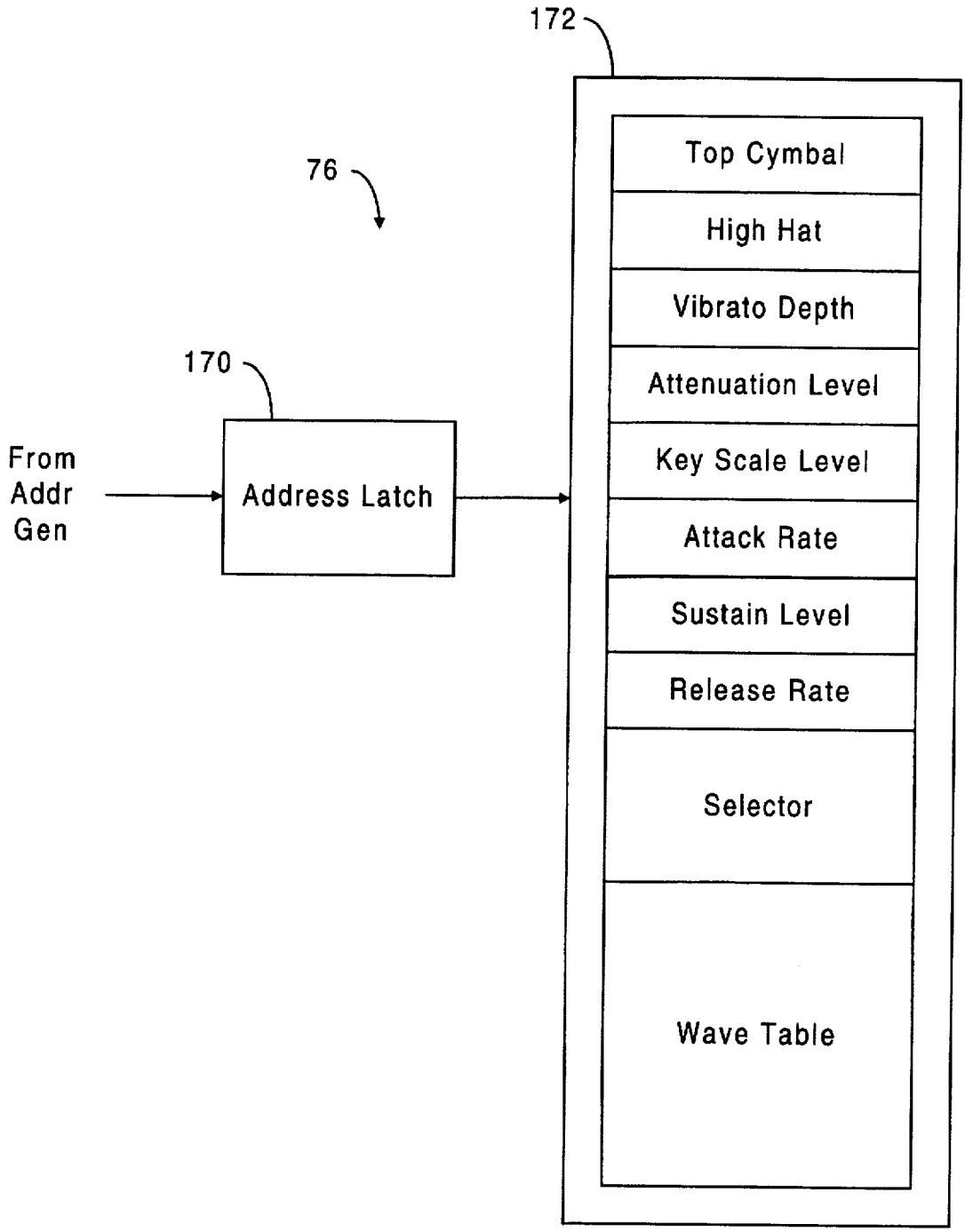
FIG. 7 is a schematic block diagram of a memory of the operator circuit of FIG. 5.

Referring to FIG. 7, memory 76 includes address latch 170 as well as storage portion 172. Storage portion 172 is, for example, a read only memory (ROM). Storage portion 172 includes a plurality of separately addressable regions. More specifically, memory 76 includes a top cymbal region which stores top cymbal waveshapes, a high hat cymbal region which stores high hat cymbal waveshapes, a vibrato depth region which stores information relating to vibrato depth, an attenuation level region which stores information relating to attenuation level, a key scale level region which stores information relating to key scale level, an attack rate region which stores information relating to the attack rate of an envelope, a sustain level region which stores information relating to the sustain level of an envelope, a release rate region which stores information relating to the release rate of an envelope, a selector region which stores selection values, and a wave table region which stores a plurality of individually addressable waveshapes.

More specifically, the top cymbal region stores a waveshape of a top cymbal. The top cymbal waveshape includes 64 top cymbal waveshape samples, each top cymbal waveshape sample being an 8-bit value. The high hat cymbal region stores a waveshape of a high hat cymbal. The high hat cymbal waveshape includes 64 high hat cymbal waveshape samples, each high hat cymbal waveshape sample being an 8-bit value.

The vibrato depth region stores a depth of vibrato values which indicate how much phase varies with frequency. The vibrato depth region stores 1024 values of vibrato depth which are accessed as a function of the OCT, FN, RF and DVB signals.

The attenuation level region provides a logarithmic-to-linear translation where a linear dB scale is provided as an input and a non-linear actual attenuation level value is provided as an output. The attenuation level region includes 64 attenuation level values.

The key scale level region is a 512-entry table, each entry being an eleven bit value. The key scale level region provides a key scale level linear output value based upon the values of the FN, OCT and KSL signals.

The sustain level region is a 16-value table which provides a logarithmic-to-linear conversion. The release rate region holds four linear time constant values. The time constant values, when scaled, produce an actual release or decay rate.

The selector region of memory 76 stores 512 4-bit selection values which are used to address particular variations of a waveshape stored within the wave table region of memory. Table 1 is an example of the 4-bit selection values stored within the selector region of memory 76. The values shown within Table 1 are shown as decimal notation corresponding to each 4-bit value. Table 1 is conceptually divided into eight groups, each group having 64 selection values. The values within the selector region are addressed by appending the 6 most significant bits of the current volume level with the 3-bit SP value. More specifically, the 3-bit SP value indexes into one of the eight groups of selection values, then the 6-bit volume level accesses one of the 64 values within each group.

TABLE 1

| | | | | | | | | | | | | | | | |
|---|---|---|---|---|---|---|---|---|---|---|---|---|---|---|---|
| Group 0 | | | | | | | | | | | | | | | |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 | 0 | 0 | 0 | 0 |
| Group 1 | | | | | | | | | | | | | | | |
| 0 | 0 | 0 | 0 | 0 | 0 | 0 | 0 | 0 | 0 | 0 | 0 | 0 | 0 | 0 | 0 |
| 0 | 0 | 0 | 0 | 0 | 0 | 0 | 1 | 1 | 1 | 1 | 1 | 1 | 1 | 1 | 1 |
| 1 | 1 | 1 | 1 | 1 | 1 | 1 | 1 | 1 | 1 | 1 | 1 | 1 | 2 | 2 | 2 |
| 2 | 2 | 2 | 2 | 2 | 2 | 2 | 2 | 2 | 2 | 2 | 3 | 3 | 3 | 3 | 3 |
| Group 2 | | | | | | | | | | | | | | | |
| 0 | 0 | 0 | 0 | 0 | 0 | 0 | 0 | 0 | 0 | 0 | 0 | 1 | 1 | 1 | 1 |
| 1 | 1 | 1 | 1 | 1 | 1 | 1 | 2 | 2 | 2 | 2 | 2 | 2 | 2 | 3 | 3 |
| 3 | 3 | 3 | 3 | 3 | 3 | 3 | 3 | 3 | 3 | 3 | 3 | 3 | 4 | 4 | 4 |
| 4 | 4 | 4 | 4 | 4 | 4 | 4 | 4 | 4 | 5 | 5 | 5 | 5 | 5 | 5 | 5 |
| Group 3 | | | | | | | | | | | | | | | |
| 0 | 0 | 0 | 0 | 0 | 0 | 1 | 1 | 1 | 1 | 1 | 1 | 2 | 2 | 2 | 3 |
| 3 | 3 | 3 | 3 | 3 | 3 | 3 | 4 | 4 | 4 | 4 | 4 | 4 | 5 | 5 | 5 |
| 5 | 5 | 5 | 5 | 6 | 6 | 6 | 6 | 6 | 6 | 6 | 6 | 6 | 7 | 7 | 7 |
| 7 | 7 | 7 | 8 | 8 | 8 | 8 | 8 | 8 | 8 | 8 | 9 | 9 | 9 | 9 | 9 |
| Group 4 | | | | | | | | | | | | | | | |
| 0 | 0 | 0 | 1 | 1 | 1 | 2 | 2 | 3 | 3 | 3 | 3 | 4 | 4 | 4 | 5 |
| 5 | 5 | 6 | 6 | 6 | 6 | 6 | 7 | 7 | 7 | 8 | 8 | 8 | 8 | 9 | 9 |
| 9 | 9 | 10 | 10 | 10 | 10 | 10 | 11 | 11 | 11 | 11 | 11 | 11 | 12 | 12 | 12 |
| 12 | 12 | 12 | 12 | 12 | 12 | 12 | 12 | 12 | 12 | 12 | 12 | 12 | 12 | 12 | 12 |
| Group 5 | | | | | | | | | | | | | | | |
| 0 | 0 | 1 | 2 | 3 | 3 | 4 | 4 | 5 | 6 | 6 | 6 | 7 | 8 | 8 | 9 |
| 9 | 10 | 10 | 10 | 11 | 11 | 11 | 12 | 12 | 12 | 12 | 12 | 12 | 12 | 12 | 12 |
| 12 | 12 | 12 | 12 | 12 | 12 | 12 | 12 | 12 | 12 | 12 | 12 | 12 | 13 | 13 | 13 |
| 13 | 13 | 13 | 13 | 13 | 13 | 13 | 13 | 13 | 13 | 13 | 13 | 13 | 13 | 13 | 13 |
| Group 6 | | | | | | | | | | | | | | | |
| 0 | 1 | 3 | 4 | 5 | 6 | 7 | 8 | 9 | 10 | 11 | 11 | 12 | 12 | 12 | 12 |
| 12 | 12 | 12 | 12 | 12 | 12 | 12 | 13 | 13 | 13 | 13 | 13 | 13 | 13 | 13 | 13 |
| 13 | 13 | 13 | 13 | 13 | 13 | 13 | 13 | 13 | 13 | 13 | 13 | 13 | 14 | 14 | 14 |
| 14 | 14 | 14 | 14 | 14 | 14 | 14 | 14 | 14 | 14 | 14 | 14 | 14 | 14 | 14 | 14 |
| Group 7 | | | | | | | | | | | | | | | |
| 0 | 3 | 5 | 7 | 9 | 11 | 12 | 12 | 12 | 12 | 12 | 12 | 13 | 13 | 13 | 13 |
| 13 | 13 | 13 | 13 | 13 | 13 | 13 | 14 | 14 | 14 | 14 | 14 | 14 | 14 | 14 | 14 |
| 14 | 14 | 14 | 14 | 14 | 14 | 14 | 14 | 14 | 14 | 14 | 14 | 14 | 15 | 15 | 15 |
| 15 | 15 | 15 | 15 | 15 | 15 | 15 | 15 | 15 | 15 | 15 | 15 | 15 | 15 | 15 | 15 |

The volume level changes linearly while the scaling parameter value changes exponentially. The selection values which are accessed within selector region of memory 76 represent the result of the multiplication of the volume level by the scaling parameter value. Accordingly, changes in the scaling parameter value have a greater effect on the selection value which is accessed than do changes in the volume level.

The selection values represent simulated feedback which correspond to a feedback range between 0 to 4π. More specifically, the selection values set forth in Table 1 correspond to simulated feedback values as set forth in Table 2. The selection values have a near geometric relationship so that they are evenly spaced when they produce sound. For example, there are more selection values located between simulated feedback values of the π/2 and π/4 selection values then between the 2π and 4π selection values. Also for example, there are more selection values located between simulated feedback values of the π/4 and π/8 selection values then between the 2π and 4π selection values.

| Selection Value | Simulated Feedback Value |
|---|---|
| 0 | 0 |
| 1 | .09817 (π/32) |
| 2 | .19635 (π/16) |
| 3 | .2618 |
| 4 | .3927 (π/8) |
| 5 | .5 |
| 6 | .625 |
| 7 | .7854 (π/4) |
| 8 | .9032 |
| 9 | 1.0367 |
| 10 | 1.1938 |
| 11 | 1.3744 |
| 12 | 1.57079 (π/2) |
| 13 | 3.1415 (π) |
| 14 | 6.28318 (2π) |
| 15 | 12.56637 (4π) |

In the preferred embodiment, the wave table region of memory 76 stores eight individually addressable basic full-period waveshapes plus 15 full-period variations of each basic waveshape. The waveshapes include, for example, a sine waveshape, a half rectified sine waveshape, a fully rectified sine waveshape, a fully rectified sine which has the second and fourth quadrants removed waveshape, a double frequency sine half of a period waveshape, a fully rectified, double period, half time sine waveshape, a square waveshape and an impulse-like waveshape. Each waveshape includes storage locations for 64 waveshape samples. Each waveshape sample is stored as an 8-bit value. The 16 versions of each basic waveshape correspond to different amounts of simulated feedback. Accordingly, 128 waveshapes in total are stored in the wave table region of memory 76.

Figure 8A:
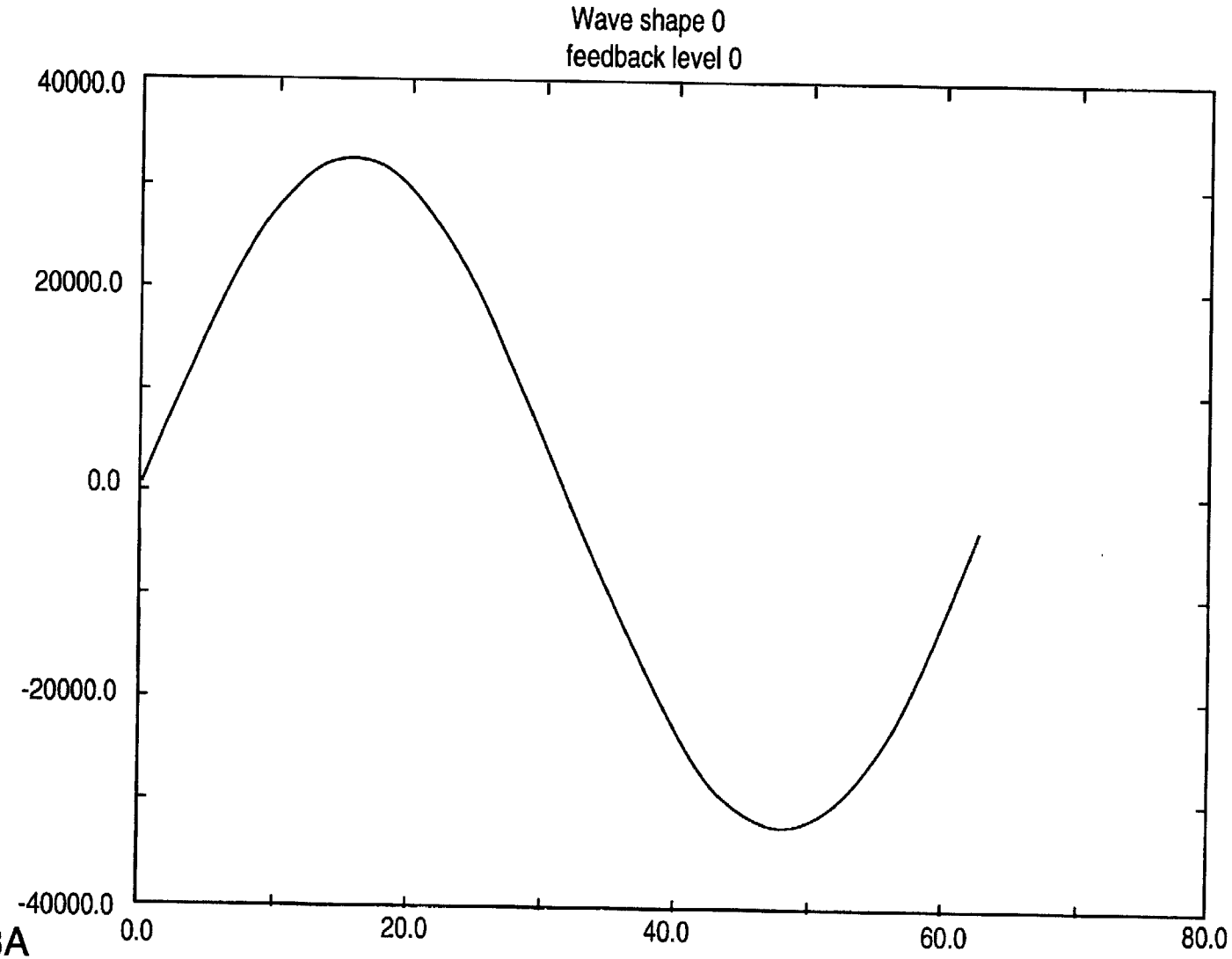
FIGS. 8A, 8B, 8C and 8D are waveform diagrams for waveshapes represented by waveshape sample values stored within the wavetable region of the memory of FIG. 7.

FIGS. 8A–8D show examples of the waveshapes generated from the information stored within the waveshape region of memory 76. More specifically, a waveshape having no simulated feedback is shown in FIG. 8A. The values that are used to generate this waveshape are set forth in Table 3. Each sample value of the wave form is an 8-bit value, i.e., a 1 byte value. These sample values are represented in hexadecimal notation. The actual waveshapes such as those shown in FIGS. 8A–8D are generated by performing a linear interpolation function between adjacent samples.

TABLE 3

| | | | | | | | |
|---|---|---|---|---|---|---|---|
| 00 | 0C | 19 | 25 | 31 | 3C | 47 | 51 |
| 5A | 62 | 6A | 70 | 75 | 7A | 7D | 7E |
| 7F | 7E | 7D | 7A | 75 | 70 | 6A | 62 |
| 5A | 51 | 47 | 3C | 31 | 25 | 19 | 0C |
| 00 | F4 | E7 | DB | CF | C4 | B9 | AF |
| A6 | 9E | 96 | 90 | 8B | 86 | 83 | 82 |
| 81 | 82 | 83 | 86 | 8B | 90 | 96 | 9E |
| A6 | AF | B9 | C4 | CF | DB | E7 | F4 |

Figure 8B:
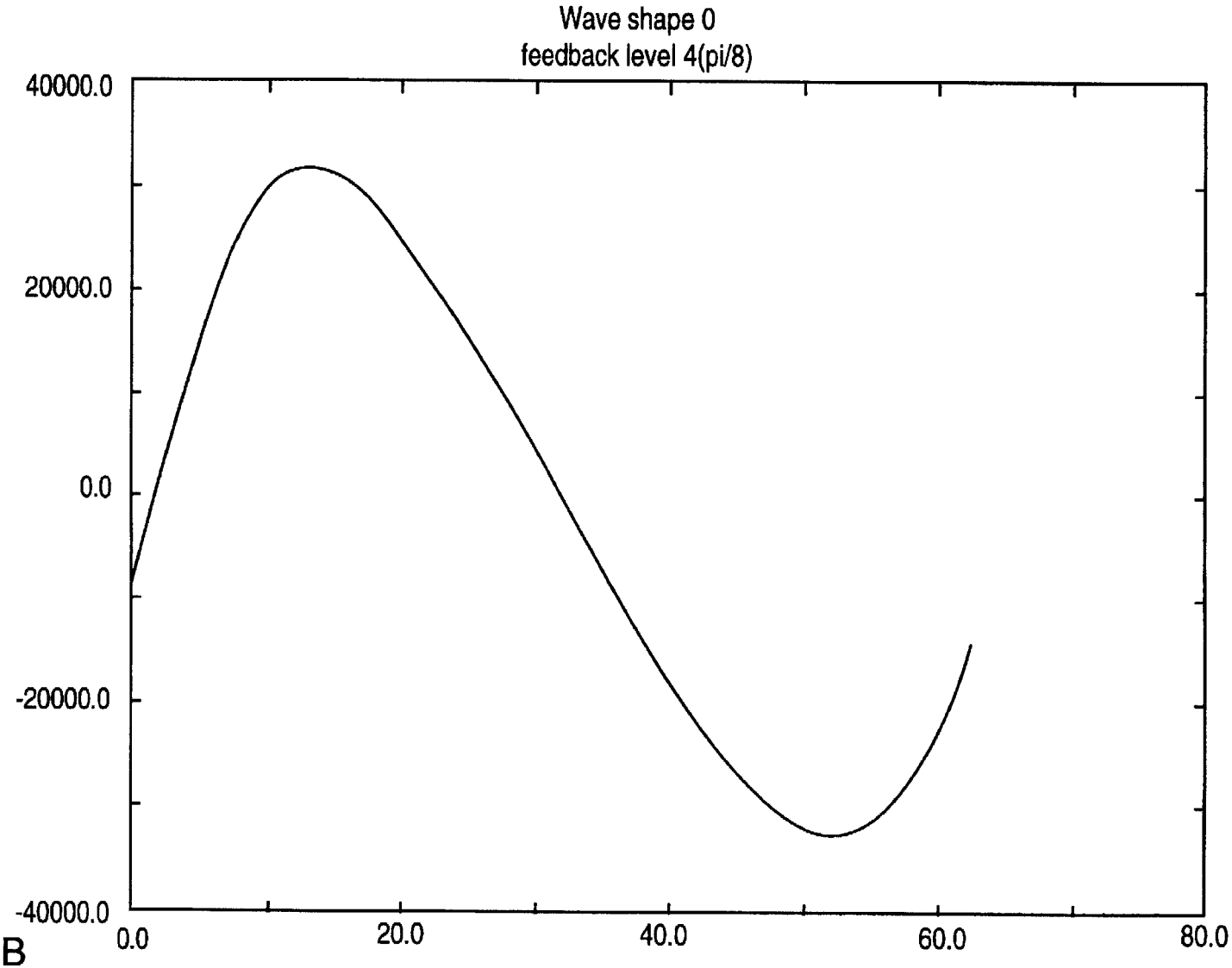

FIG. 8B shows a waveform having a slight amount of simulated feedback. This waveform is accessed with the selection value of four. The sampling values used to generate this waveshape are set forth in Table 4.

TABLE 4

| | | | | | | | |
|---|---|---|---|---|---|---|---|
| DB | ED | FF | 12 | 24 | 36 | 47 | 55 |
| 62 | 6C | 73 | 79 | 7C | 7D | 7D | 7B |
| 79 | 75 | 70 | 6B | 65 | 5F | 58 | 50 |
| 49 | 41 | 38 | 30 | 27 | 1F | 16 | 0D |
| 04 | SP | F2 | E9 | E1 | D8 | CF | C7 |
| BF | B8 | B0 | A9 | A2 | 9C | 97 | 91 |
| 8D | 89 | 86 | 84 | 82 | 82 | 83 | 85 |
| 88 | 8D | 93 | 9B | A4 | AF | BC | CB |

Figure 8C:
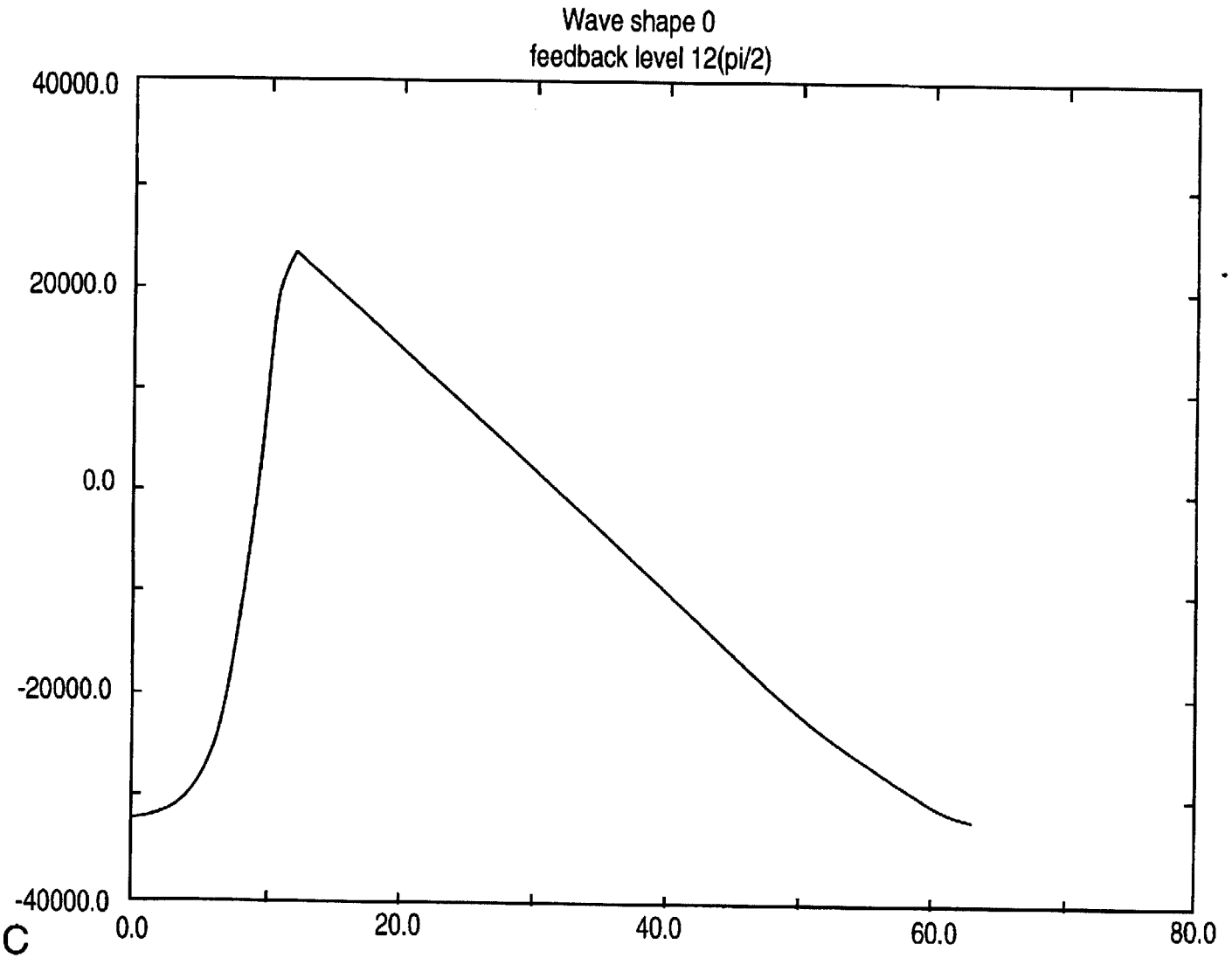

FIG. 8C shows a waveform having a large amount of feedback. This waveform is accessed with the selection value of twelve. The sampling values used to generate this waveshape are set forth in Table 5.

TABLE 5

| | | | | | | | |
|---|---|---|---|---|---|---|---|
| 82 | 82 | 83 | 85 | 89 | 90 | 9A | AB |
| C5 | EC | 21 | 50 | 5C | 58 | 54 | 4F |
| 4B | 46 | 42 | 3D | 39 | 34 | 2F | 2A |
| 26 | 21 | 1C | 17 | 12 | 0D | 09 | 04 |
| FF | FA | F5 | F0 | EC | E7 | E2 | DD |
| D9 | D4 | CF | CB | C6 | C1 | BD | B8 |
| B4 | B0 | AB | A7 | A3 | 9F | 9B | 98 |
| 94 | 91 | 8E | 8B | 88 | 86 | 84 | 83 |

Figure 8D:
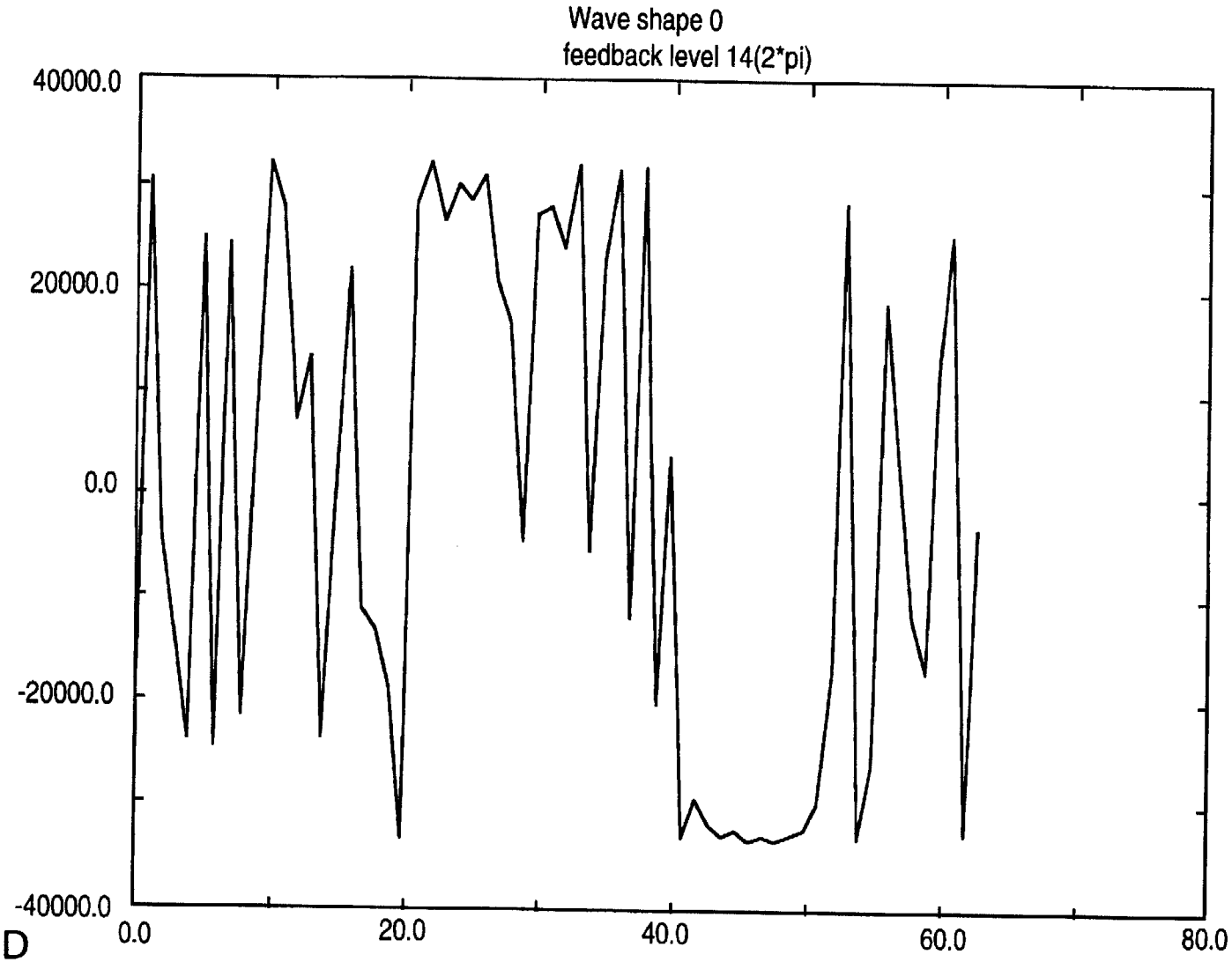

FIG. 8D shows a waveform having a large amount of simulated feedback. This waveform is accessed with the selection value of fourteen. This waveform is an example of a waveform which includes a large amount of noise. However, there is a periodic aspect to the noise. More specifically, during the second half of each period, there is a portion of the waveshape that is consistently produced. The sampling values used to generate this waveshape are set forth in Table 6.

TABLE 6

| | | | | | | | |
|---|---|---|---|---|---|---|---|
| 99 | 78 | F1 | C8 | A4 | 62 | A1 | 60 |
| AD | 08 | 7E | 6D | 1D | 34 | A5 | EE |
| 56 | D5 | CE | B8 | 80 | 70 | 7F | 69 |
| 77 | 71 | 7B | 53 | 43 | EF | 6C | 6F |
| 5F | 7F | EB | 5A | 7D | D3 | 7E | B3 |
| 10 | 82 | 90 | 86 | 82 | 84 | 80 | 82 |
| 80 | 82 | 84 | 8E | C0 | 72 | 81 | 9E |
| 4C | 05 | D4 | C0 | 32 | 65 | 83 | F6 |

Figure 9A:
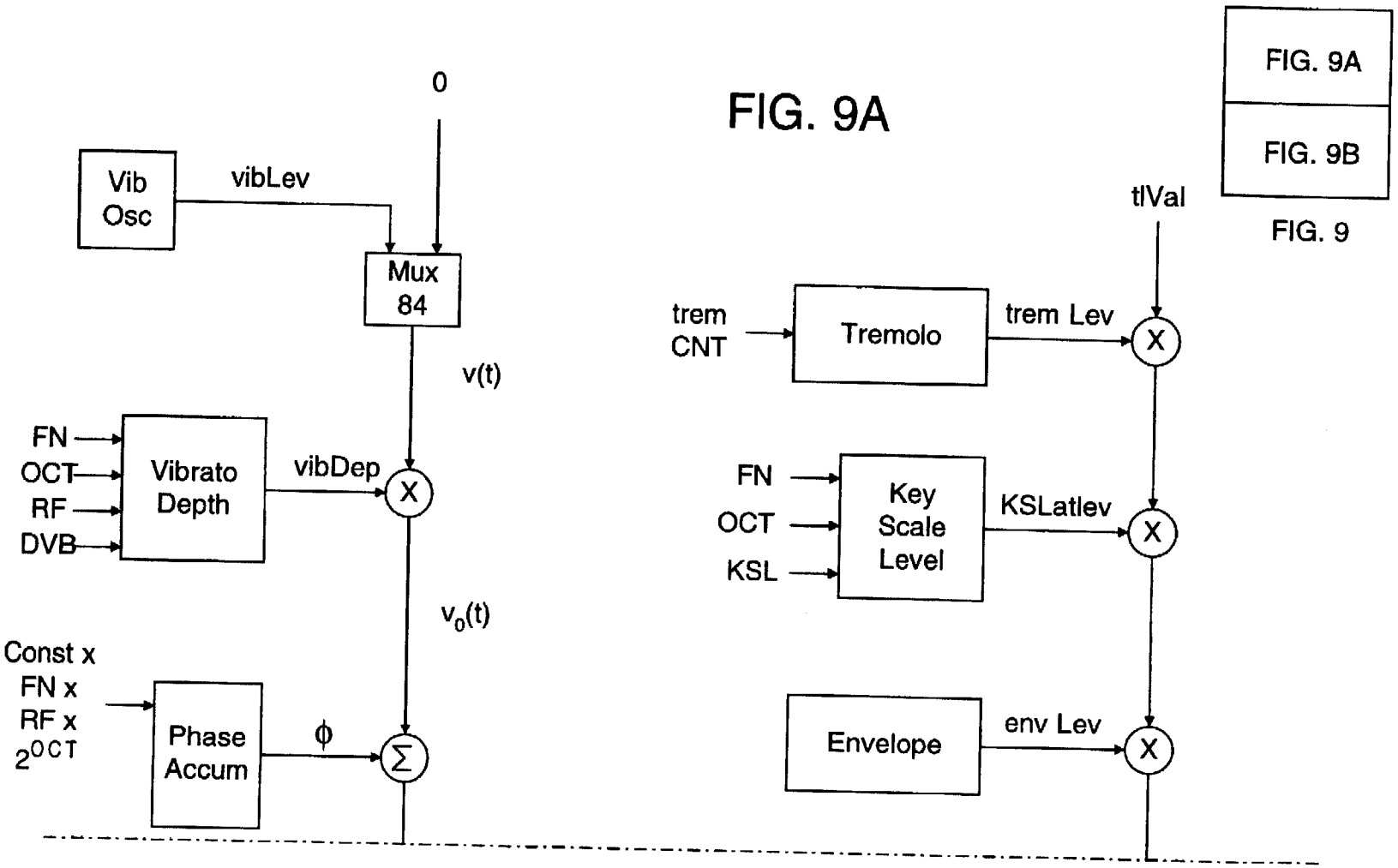
FIG. 9 is a functional block diagram of the operation of the operator structure of the tone signal generator of FIG. 3.
Figure 9B:
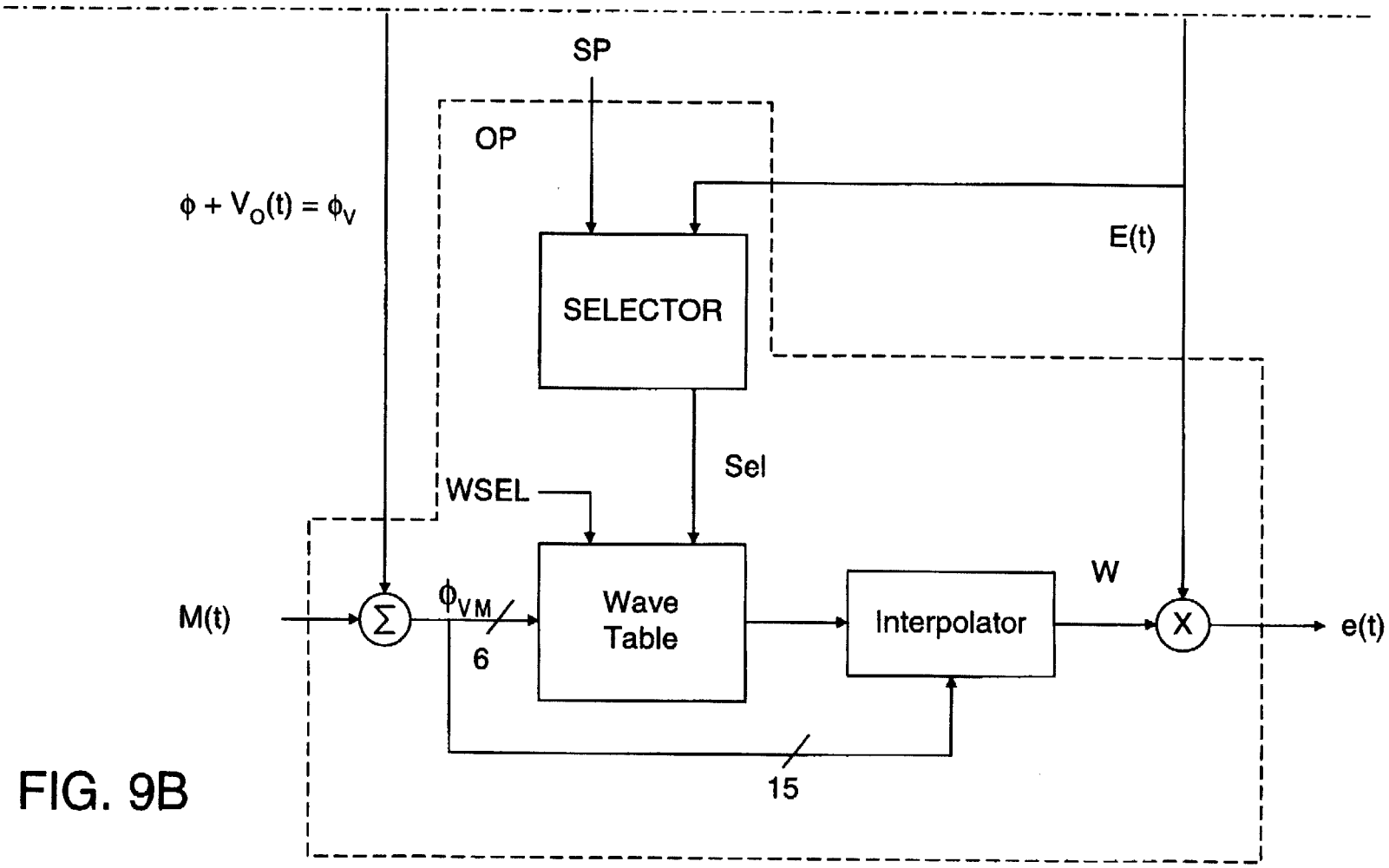

FIG. 9 shows an example of how a time-multiplexed real operator is functionally configured to perform FM operator calculations. The real operator circuitry 60 is functionally configured as shown by dashed line "OP". More specifically, real operator 60 produces an operator output signal (e(t)) according to the relationship:

$$e(t)=E(t)\times W(\phi+M(t)+v_0(t)) \quad \text{(Eq. 1)}$$

where E(t) is the output amplitude envelope, $\phi$ is the accumulated phase angle, M(t) is a modulation input which is based upon a previous operator, $v_0(t)$ is a vibrato value, and W is a waveshape function of the sum of $\phi$, M(t), and $v_0(t)$. Phase angle parameter $\phi$ is digitally equivalent to $\omega t$, where $\phi$ is an angular frequency, and t is time. Amplitude envelope E(t) constitutes an attack, decay, sustain, and release ("ADSR") envelope curve multiplied by total level (tlVal), key sealing (KSLattlev), and tremolo (trem Lev) parameters.

Operator input signals which are used in calculating a virtual operator include the octave indicator OCT, the frequency number FN, the frequency-ratio multiplier RF, vibrato depth DVB, and the feedback signal SP which are stored within temporary register circuit 48. Additional operator input signals which are produced from values stored within temporary register circuit 48 include the total output level parameter tlVal which is accessed from the attenuation region of memory 76 by the user value total level (TL), and key sealing level KSLattLev.

Octave indicator OCT identifies the octave of the tone signal to be produced in the tone-generation channel containing the operator. Frequency number FN (10 bits) prescribes the location of the tone signal within the octave. Multiplier RF sets the frequency ratio between each pair of operators in the channel at one of a specified group of ratios. Parameters OCT and FN are the same for all the virtual operators in a tone-generation channel, whereas parameter RF can differ from operator to operator in the channel.

The vibrato depth parameter DVB is a bit that causes vibrato to be set at a low-amplitude depth or a high-amplitude depth. Feedback parameter SP identifies how much feedback is to be simulated in an operator. Total level parameter tlVal establishes the basic level of output amplitude envelope E(t). Key scaling level parameter KSLattLev adjusts the desired amplitude envelope as a function of the desired fundamental frequency.

Sub-audio input signals include vibrato level (vibLev), tremolo level (tremLev), and amplitude envelope level (envLev). Vibrato level vibLev oscillates at the vibrato frequency and has a generally trapezoidal shape as a function of time during each oscillation period. When tremolo is present, parameter tremLev is an approximate triangular wave that oscillates at the tremolo frequency and has either a low or high amplitude. Parameter tremLev is one when tremolo is absent. Amplitude envelope level envLev is an ADSR amplitude envelope.

Additionally, operator circuit 60 receives modulation input signal M(t). When operator circuit 60 is calculating a virtual operator modulated by the previous virtual operator, modulation input M(t) is the output e(t) of the previous operator. Otherwise, modulation input M(t) is zero.

Referring to FIGS. 5 and 9, in operation, the calculation of a note or operator sample is divided into a sequence of 11 steps performed during respective clock cycles of the system clock. During the first clock cycle, a subcalculation which generates the 6-bit address ($\phi_{VM}$) for accessing a wave shape sample within the wave table region of memory 76 is performed. Vibrato depth is generated as a table lookup based upon the values DVB, FN, OCT and RF. This vibrato depth value is multiplied by the current value of the vibrato oscillator (vibLev), added to the current phase accumulator value ($\phi$) and placed in temporary register 98. Calculation of a new phase accumulator value also begins in cycle 1.

More specifically, vibrato level vibLev is supplied to multiplexer 84 by vibrato counter 110. Vibrato counter 110 counts up to a predetermined value, waits, counts down to a predetermined value, saturates and then counts back up; i.e., vibrato counter 110 functions as a state machine, having a count up state, a wait state and a count down state. Another input signal to multiplexer 84 is a zero-level signal. Multiplexer 84 provides one of these input signals as the output signal v(t) to multiplier 88. Accordingly, during this clock cycle, signal v(t) equals either vibLev or zero depending on whether or not vibrato is desired. The vibrato depth value (vibDep) is provided as a table look-up within the vibrato depth portion of memory 76. The address for accessing the vibrato depth value is generated by address generator 74 based upon the parameters FN, OCT, RF, and DVB according to the following relationship:

$$vibDep=CVib\times RF\times 2^{OCT}\times FN \quad \text{(Eq. 2)}$$

where CVib is a vibrato constant having one of two values depending on the state of vibrato depth bit DVB. A high CVib value causes the fundamental frequency of the tone to vary across a range approximately equal to 0.12% of the fundamental frequency. For a low CVib value, the range is approximately 0.06% of the fundamental frequency. The vibDep value is provided to multiplexer 82 which during this clock cycle provides this value to multiplier 88. Multiplier 88 calculates the signal $v_0(t)$ as the product of vibrato depth vibDep and signal v(t). Accordingly, $$v_0(t)=vibDep\times vibLev \quad \text{(Eq. 3)}$$

when vibrato is present. When vibrato is not present, the signal $v_0(t)$ equals zero. The signal $V_0(t)$ is passed through shifter 90 and logic 94 to adder 96.

Additionally, beginning in this cycle, an incremental phase angle signal $\Delta\phi$, digitally equivalent to $\omega dt$, is calculated by phase generator 62 as $$\Delta\phi=Cph\times RF\times 2^{OCT}\times FN \quad \text{(Eq. 4)}$$

where Cph is a phase angle constant which represents a shift value to compensate for table size and sample rate of an output data stream; in the preferred embodiment Cph has a unitless value of 1. Phase angle accumulator 64 accumulates the incremental phase angle $\Delta\phi$ to produce a new accumulated phase angle $\phi$ for the operator being generated. The previous accumulated phase angle $\phi$ is provided to adder 96 via multiplexer 86 and logic 94. Parameter $v_0(t)$ and phase angle $\phi$ are added together at adder 96 to produce a further phase angle signal $\phi+v_0(t)=\phi_V$.

During cycle 2, modulation input M(t), which is held in volume register 80, is provided via logic 94 to adder 96. Additionally, phase angle $\phi+v_0(t)$, held in temporary register 98, is provided via multiplexer 86 and logic 94 to adder 96. Adder 96 adds modulation input M(t) and phase angle $\phi+v_0(t)$ to generate the 21-bit (potentially modulated) phase angle signal $\phi_{VM}$. This value is then provided to phase angle register 78.

During cycle 3, the value of the envelope is updated. If the envelope is in the attack phase (i.e., increasing in value), the current envelope value is scaled by a factor generated by a table lookup. If the envelope is in either the decay or release phase, the increment is negated and added to the current envelope level. Specifically, the current envelope level is read from envelope register 66. The current envelope level is provided via multiplexer 86 and logic 94 to adder 96. Depending upon the location within the ADSR curve, either an attack, a release, or a decay rate is accessed from memory 76. The envelope update function is performed under control of the envelope circuit 156 of sequence control circuit 40 (see FIG. 4). The attack, decay or release rate is provided via multiplexer 82 to multiplier 88. Multiplexer 84 provides a "1" to multiplier 88 during the attack phase. Multiplexer 84 provides the envelope level to multiplier 88 during the decay and release phases. Multiplier 88, shifter 90 and logic 94 appropriately scale the rate provided via multiplexer 82 under control of envelope circuit 156 to provide a more precise attack, decay or release rate. The appropriately sealed rate is provided to adder 96 via logic 94. Adder 96 adds the decay and release rates to the previously stored envelope level. The resulting value is provided to temporary register 98 and also back into the corresponding envelope level register 66.

During cycle 4, calculation of the output amplitude envelope (i.e., the operator output scaling factor) E(t) is initiated. The total level parameter tlVal is multiplied by the current value tremLev of the tremolo oscillator. Specifically, the total level parameter is accessed from the attenuation region of memory 76 based upon TL. The total level parameter is provided via multiplexer 82 to multiplier 88. Multiplexer 84 receives a values generated by either the tremolo low oscillator 112 or the tremolo high oscillator 114 as the tremolo count TREM CNT signal based upon the state of the depth of amplitude modulation DTR signal. Additionally, multiplexer 84 also receives a "1" value. If tremolo is present, the tremolo count value passes through multiplexer 84. Otherwise, the "1" value is passed by multiplexer 84. Multiplier 88 multiplies these values to provide a partial output scaling factor which is provided to temporary register 98.

During cycle 5, calculation of output scaling factor E(t) continues. The partial output scaling factor from cycle 4 is multiplied by the key scaling parameter KSLattLev. Specifically, the partial output scaling factor from temporary register 98 is provided to multiplexer 84, which passes this value to multiplier 88. Additionally, the key scaling parameter is retrieved from memory 76 and provided to multiplier 88 via multiplexer 82. Multiplier 88 multiplies the key scaling parameter by the partial output scaling factor to produce a second partial scaling factor. This second partial scaling factor is stored in temporary register 98.

During cycle 6, the calculation of output scaling factor E(t) is completed when the second partial scaling factor is multiplied by current envelope value envLev. Specifically, the second partial scaling factor is provided to multiplier 88 via multiplexer 82. Additionally, current envelope value envLev is provided from envelope register 66 to multiplier 88 via multiplexer 84. These values are multiplied to produce the output sealing factor E(t) which is written to volume register 80. Additionally, during cycle 6, phase generator 62 completes calculation of a new $\phi$ value.

During cycle 7, scaling parameter SP and the six most significant bits of output sealing factor E(t) are supplied to address generator 74 which generates an address for accessing one of the 512 entries of the selector region of memory 76. The memory access produces a 4-bit sub-wave number Sel having one of 16 values. Cycle 7 is skipped if the operator does not simulate feedback.

During cycle 8, the current integer value of the sample is fetched from the wave table region of memory 76. Additionally, the new phase accumulator value, which was calculated during cycles 1–6, is loaded into phase accumulation register 64. Specifically, sub-wave number Sel, the six most significant bits of phase angle signal $\phi(t)$, and waveshape-select control signal WSEL are supplied to address generator 74 which uses these values to generate the address for accessing the appropriate value within the waveshape region of memory 76. This access provides the output waveshape value W.

The value of waveshape select WSEL selects one of eight basic waveshapes. The value of sub-wave number Sel selects one of 16 versions of the selected basic waveshape. The waveshape versions vary from a waveshape simulating a waveshape to which no feedback is applied to a waveshape simulating a waveshape to which a large amount of feedback is applied. Wave table output signal W is supplied from the selected waveshape table as the value of the selected waveshape variation at the location determined by phase angle $\phi_{VM}$. The waveshape sample value is provided via multiplexer 82 to exclusive OR gate 106, which is also provided with a signal of all "1" values. Accordingly, exclusive OR gate provides as an output the two's complement of the waveshape value when used with a carry-in. This two's complement of the waveshape value is provided to temporary registers 98 because multiplexer 86 provides a "0" as the other input to adder 96.

During cycle 9, the sample for the next waveshape value is accessed, and the difference between the sample fetched in cycle 8 and the present sample is obtained. Specifically, address generator 74 increments the address to access the next waveshape sample in the waveshape region of memory 76. This value is provided to adder 96 via multiplexer 82. Additionally, the two's complement of the previous waveshape sample is provided to adder 96 from temporary register 98 via multiplexer 86 and logic 94. By adding the two's complement, adder 96 performs a subtraction between the two waveshape samples. This difference is held in temporary register 98.

During cycle 10, a linear interpolation between the two samples is performed. Additionally, under certain conditions, a noise signal is optionally added to this result to simulate the random characteristics of an operator having high amounts of feedback. Specifically, a fractional portion (bits 0–14) of the phase angle value held in phase angle register 78 is provided via multiplexer 82 to multiplier 88. This fractional value is aligned by phase angle register 78 so that the fractional value is provided to multiplexer 82. The fractional phase angle value is provided to multiplier 88 where the fractional value is multiplied by the difference between the two waveshape samples which is provided via multiplexer 84. This value is provided to adder 96. Address generator 74 also accesses the previous waveshape value and provides this value to adder 96 via multiplexer 86. Adder 96 provides the interpolated value, which is held in temporary register 98 as the value val0.

There are a number of situations in which noise is applied to the interpolated sample value. When a high hat or top cymbal waveshape is chosen, noise is added to waveshape samples which have the least significant bit of the waveshape sample set over the entire period of the waveshape. Also when a snare drum waveshape is generated from the waveshapes stored in the waveshape region of memory 76, noise is added to waveshape samples which have the least significant bit of the waveshape sample set over the entire period of the waveshape. When a selection value of 14 or 15 is chosen for any waveshape stored in the wave table region of memory 76, noise is added to at least a portion of the period of the waveshape based upon waveshape samples which have the least significant bit of the waveshape sample set.

In the case of the top cymbal, high hat cymbal or snare drum, when noise could be added anyplace within the waveshape, the least significant bit of the waveshape value is monitored by slave sequencer circuit 150 of control circuit 22. If the least significant bit is "1", multiplexer 108 of logic 94 inserts the value from random number generator 92 into bit locations 11–22 of the signal provided by multiplexer 86 (the previous waveshape value). Accordingly, when this value is ultimately provided as an output value, a non periodic output value is generated.

When the selection value is above a certain amount, noise is added to certain predetermined portions of the waveshape depending on the particular selection value. Specifically, when the simulated feedback amount of portions of the waveshape approach an oscillating amount, this indicates that noise should be added to the oscillating portion of the waveshape. The oscillating portion of the waveshape represents portions of the waveshape which would have uncorrelated feedback amounts if feedback were actually applied to the waveshape. Thus, during these portions of the waveshape, the least significant bit of the sample is set to "1", causing noise to be generated. For example, the waveshape shown in FIG. 8D, whose values are set forth in Table 6, includes 27 samples in which the least significant bit is set. During these samples, noise is provided to the actual waveshape sample provided by memory 76.

During cycle 11, the final operator output value e(t) is calculated. The interpolated sample value calculated in cycle 10 is multiplied by the output sealing factor E(t) to produce the operator output value e(t). Specifically, the interpolated sample value held in temporary register 98 as W is provided to multiplier 88 via multiplexer 84. Multiplier 88 also receives the output scaling factor E(t) from volume register 80 via multiplexer 82. This final operator output value is then provided back to volume register 80. Additionally, this value is provided to pass/no pass holding buffer 104 which selectively provides this value to adder 106 as the operator output value e(t). Depending on the operator mode, the operator output value e(t) is selectively added to the contents of register circuit 30 to provide the final operator output value.

Figure 10:
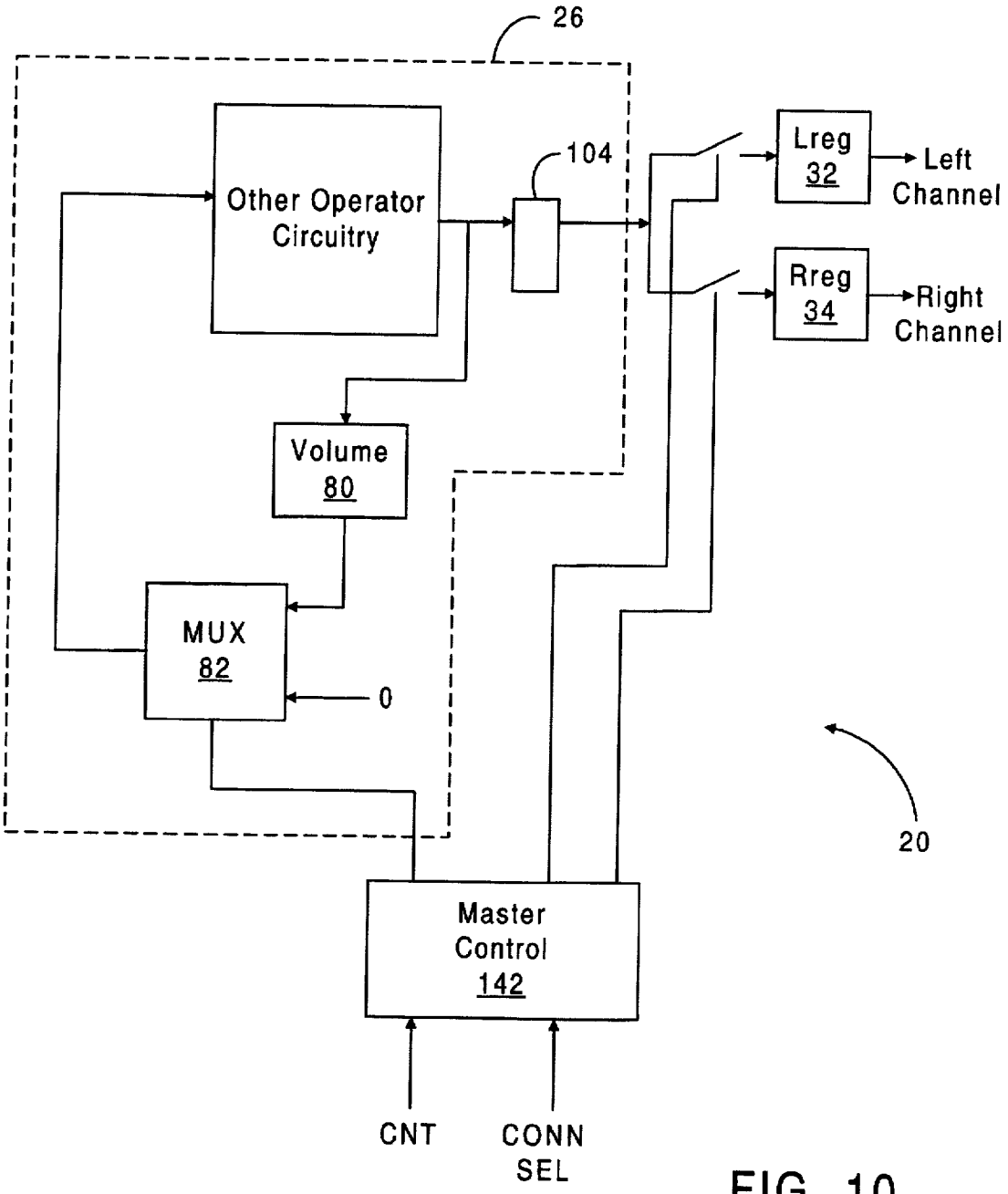
FIG. 10 is a functional block diagram of the operation of the tone signal generator of FIG. 3.

FIG. 10 shows how portions of tone signal generation circuit 26 functionally interface with other parts of tone signal generator 20 for combining the calculations of multiple virtual operators. Depending on the operator interconnections desired, master control circuit 142 causes operator output e(t) stored in register Volume to be supplied either to the next virtual operator or to one or both of registers Lreg and Rreg in the two audio output channels.

Each of the 36 virtual operators in tone signal generator 20 is calculated in 36 time slots at one operator per time slot. In each subsequent cycle of 36 time slots, the 36 virtual operators are re-calculated in the same order as in the initial cycle of time slots. Each virtual operator thus has a fixed position in the calculation cycles.

During a calculation cycle in tone signal generator 20, virtual operators are interconnected by utilizing the calculated output e(t) of one virtual operator as the modulation input M(t) for the next virtual operator calculation. Additionally, output e(t) of the first-mentioned operator is supplied to the output stereo accumulator. In other words, output e(t) of each virtual operator goes to both the output stereo accumulator via buffer 104 and is supplied to the next operator as its modulation input M(t). More specifically, output e(t) is loaded into volume register 80 at the same time that, as applicable, output e(t) goes to one or both of output registers Lreg and Rreg 32, 24, respectively. Later, either output e(t) or a "0" is supplied via multiplexer 82 as the modulation input signal M(t).

When an operator is not modulated by output signal e(t) of the prior operator (and thus not by any earlier operator), modulation input M(t) of the first-mentioned operator equals zero. Also, when an operator is in a tone-generation channel not intended to contribute to the stereo polyphonic output tone signal, envelope level envLev or total level tlLev is set to zero. Consequently, output e(t) of the operator equals zero during the period of non-contribution.

Tone signal generator 20 is structured so as to permit the virtual operators to be timewise interconnected in specified configurations (or algorithms), each defining an internal tone-generation channel. In particular, the virtual operators can be timewise interconnected in two-operator and four-operator configurations. The preferred embodiment includes a pair of two-operator configurations and four four-operator configurations.

Figure 11:
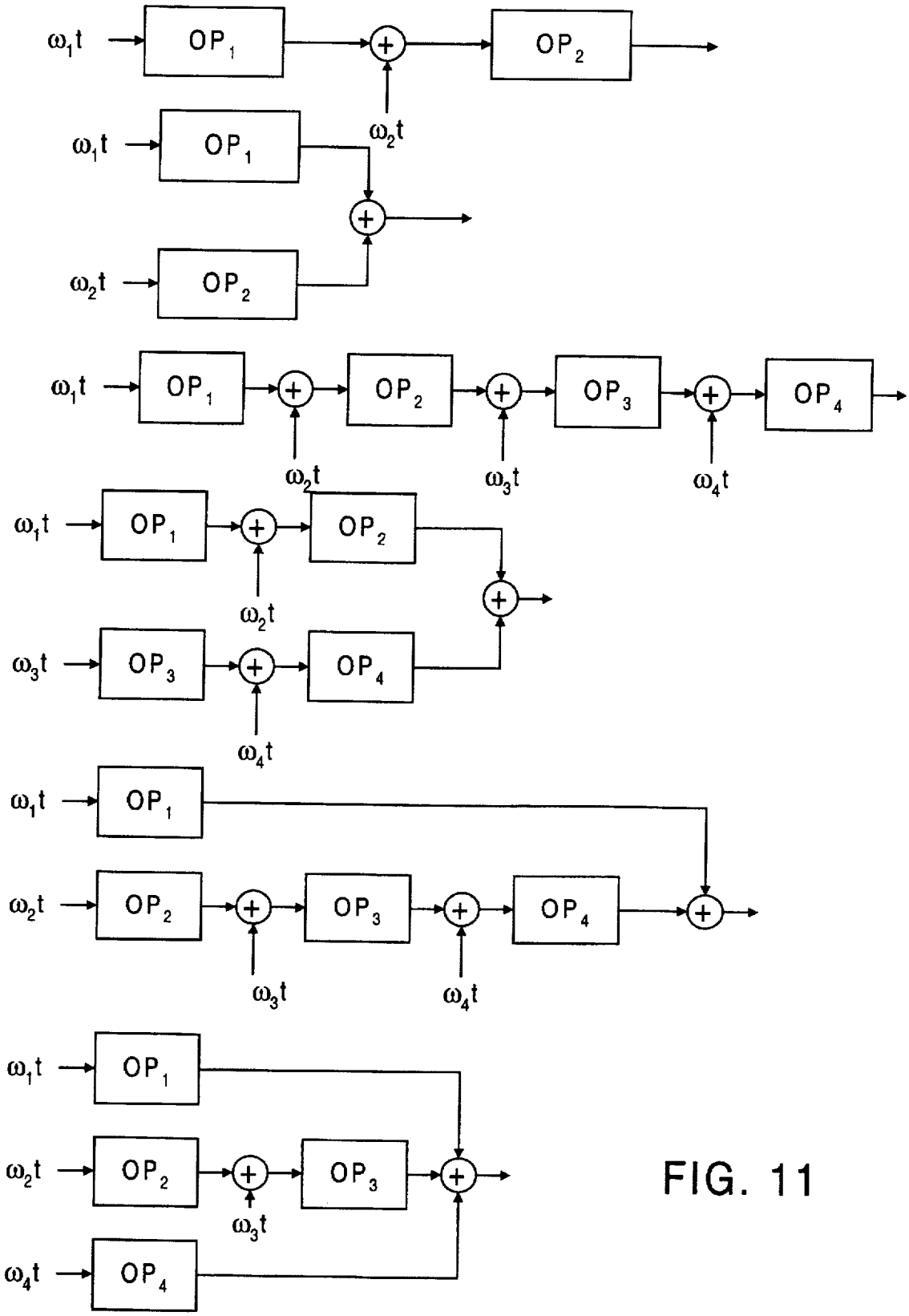
FIG. 11 is a block diagram that pictorially illustrates the multioperator algorithms implemented by the tone signal generator of FIG. 3.

FIG. 11 illustrates six different multi-operator configurations which can be employed in tone signal generator 20. In FIG. 9, the label "OP" accompanied by a numbered subscript identifies a virtual operator calculated using tone signal generation circuit 60. The label "ωt" accompanied by a numbered subscript for "ω" corresponds to accumulated phase angle ϕ. For simplicity, vibrato is not depicted in the multioperator configurations. Additionally, for clarity, the adders which are within tone signal generation circuit 60 are shown separate from the virtual operator representations.

The first two-operator configuration provides FM tone synthesis of the phase modulation type. Applying Eq. 1 to the first two-operator configuration with $v_0(t)$ set to zero and M(t) equal to zero for the first operator yields:

$$e(t)_2=E(t)_2\times W_2[\phi_2+W_1(\phi_1)] \quad \text{(Eq. 5)}$$

If W is a sine wave, replacing the symbols in Eq. 5 with standard FM symbols leads to the basic FM relationship:

$$e(t)=A(t)\sin[\omega_c t+I(t)\sin\omega_m t] \quad \text{(Eq. 6)}$$

Tone signal generator 20 may be configured to be used in a number of modes defined by different arrangements of the tone-generation channels. When the DTMF capability is not being used, there are fourteen distinguishable modes. In terms of the number of four-operator algorithms used in each distinguishable mode, Table 7 summarizes (a) the two modes having the minimum number (zero) of four-operator algorithms and (b) the two modes having the maximum number (six) of four-operator algorithms. The number preceding each "X" in Table 1 identifies the number of "tone-generation channels" created from the indicated virtual operators, while the number following each "X" identifies the number of operators in the indicated tone-generation channels.

TABLE 7

| Virtual Operator | Modes Having No 4-Operator Algorithms | | Modes having Maximum 4-Operator Algorithms | |
|---|---|---|---|---|
| Numbers | Normal | Rhythm | Normal | Rhythm |
| 1–12 | 6 × 2 | 6 × 2 | 3 × 4 | 3 × 4 |
| 12–18 | 3 × 2 | 4 × 1 + 1 × 2 | 3 × 2 | 4 × 1 + 1 × 2 |
| 19–30 | 6 × 2 | 6 × 2 | 3 × 4 | 3 × 4 |
| 31–36 | 3 × 2 | 3 × 2 | 3 × 2 | 3 × 2 |
| Total Channels | 18 | 20 | 12 | 14 |

Tone signal generator 20 has seven normal modes in which all the tone-generation channels consist of two-operator channels and from zero to six four-operator channels. Each two-operator channel can use either of the two-operator configurations shown. Likewise, each four-operator channel can use any of the illustrated four-operator configurations shown. Each of the normal modes has a "rhythm" (or percussion) variation in which six virtual operators form four one-operator channels and one two-operator channel.

The tone signals provided by the tone-generation channels during each calculation cycle (36 consecutive time slots) are additively combined at the Lreg and Rreg registers 32 and 34 in the stereo output accumulator. If a tone-generation channel is not intended to contribute to the final polyphonic digital tone signals produced during a calculation cycle, the tone signal for that tone-generation channel is provided at a zero value to the stereo output accumulator. When the tone signal for the last tone-generation channel in a calculation cycle has been accumulated into registers Lreg and Rreg, the resultant data in registers Lreg and Rreg constitutes a composite audio signal for that cycle. The composite audio signal is then transferred from registers Lreg and Rreg to the output DAC for subsequent conversion into sound.

Other Embodiments

Other embodiments are within the following claims.

For example, while the preferred embodiment describes wave tables which store waveshapes along with variations of waveshapes corresponding to various amounts of simulated feedback, it will be appreciated that any waveshapes may be stored within the wave tables. Accordingly, the present invention allows tone signals to be generated which would be impossible to produce with feedback. Additionally, the present invention provides great flexibility in the types of tone signals which may be generated.

What is claimed is:

1. A tone signal generator comprising:

first tone signal generation means for producing a dual-tone, multi-frequency ("DTMF") audio signal;

second tone signal means for producing a plurality of non-DTMF audio signals;

storage means for storing data that represents at least one channel of an output audio tone signal; and selection means for selectively loading the DTMF signal into the storage means and for selectively accumulating the non-DTMF signals into the storage means so as to generate the output tone signal.

2. A tone signal generator as in claim 1 wherein the non-DTMF signals comprise frequency-modulated signals.

3. A tone signal generator as in claim 1 wherein the selection means comprises:

a combiner that combines each non-DTMF signal with data in the storage means to produce a composite non-DTMF signal;

and a multiplexer for selectively supplying the DTMF signal and the composite non-DTMF signal to the storage means.

4. A tone signal generator as in claim 3 wherein the storage means comprises at least two registers, each providing a different channel of the output tone signal.

5. A tone signal generator as in claim 1 wherein the first tone signal means comprises:

a low-tone group of operators, each providing a low-tone audio signal at a different frequency below a specified frequency;

a high-tone group of operators, each providing a low-tone audio signal at a different frequency above the specified frequency;

a DTMF selector that selects one of the low-tone signals and one of the high-tone signals; and a DTMF combiner that combines the selected low-tone signal and the selected high-tone signal to produce the DTMF signal.

6. A tone signal generator as in claim 5 wherein the operators in the first tone signal means are physically distinct from one another.

7. A tone signal generator as in claim 1 wherein the second tone signal means comprises operation circuitry that is time-division multiplexed to generate a plurality of operators.

8. A tone signal generator as in claim 7 wherein each operator calculates an operator tone signal by impressing an envelope signal on an output waveform signal that is a function of the combination of a phase angle and, when non-zero, a modulation input signal, the output signal of one of the operators being usable to produce the modulation input for a later one of the operators.

9. A tone signal generator as in claim 7 wherein the second tone signal means comprises:

a waveform generator that furnishes a waveform signal in response to a phase angle address signal, the waveform generator comprising a plurality of wave tables each storing a different waveform;

a wave-table selector that selects one of the wave tables in response to a plurality of selection signals such that the selected wave table largely provides the waveform signal upon being addressed largely by the phase angle address signal, whereby selection of the selected wave table varies with each selection signal; and an enveloper that impresses an envelope signal on the waveform signal to generate a tone signal that selectively constitutes one of the non-DTMF signals or is incorporated into a subsequent generation of the phase angle address signal.

10. A tone signal generator as in claim 9 wherein the envelope signal largely constitutes one of the selection signals.

11. The tone signal generator of claim 1 further comprising:

converter means for converting the data in the storage means from a digital form to an analog form.

12. The tone signal generator as in claim 1 wherein:

the second tone signal means producing each of the plurality of non-DTMF audio signals in digital form.

13. The tone generator as in claim 1 further comprising:

a controller means for controlling the operation of the first tone signal generation means, the second tone signal means, and the selection means.

14. The tone generator as in claim 13 further comprising:

a bus connected to the controller means for providing parameters to the controller for controlling the operation of the second tone signal means.

15. A tone signal generator comprising:

first tone signal generation means for producing a dual-tone, multi-frequency ("DTMF") audio signal;

second tone signal means for producing a plurality of non-DTMF audio signals;

storage means for storing data that represents at least one channel of an output audio tone signal; and selection means for selectively loading the DTMF signal into the storage means and for selectively accumulating the non-DTMF signals into the storage means so as to generate the output tone signal, wherein the selection means comprises:

a combiner that combines each non-DTMF signal with data in the storage means to produce a composite non-DTMF signal;

a multiplexer for selectively supplying the DTMF signal and the composite non-DTMF signal to the storage means.

16. A tone signal generator as in claim 15 wherein each non-DTMF signal is selectively combined with the data in the storage means to produce the composite non-DTMF signal.

17. A tone signal generator as in claim 15 wherein the non-DTMF signals comprise frequency-modulated signals.

18. A tone signal generator as in claim 15 wherein the storage means comprises at least two registers, each providing a different channel of the output tone signal.

19. The tone signal generator as in claim 18 wherein the combiner combines each non-DTMF signal with data in at least two of the at least two registers to produce the composite non-DTMF signal.

* * * * *